United States Patent [19]

Ariyama et al.

[11] Patent Number: 4,800,839

[45] Date of Patent: Jan. 31, 1989

[54] DEVELOPING DEVICE FOR ELECTROPHOTOGRAPHIC COLOR COPIER

[75] Inventors: Kenzo Ariyama, Yokohama; Manabu Mochizuki, Shizuoka; Tsuneo Kunotori; Kenji Kojima, both of Tokyo; Masato Jinbo, Fukushima; Hiroaki Takenouchi, Tokyo; Yuichi Kobayashi, Yokohama, all of Japan

[73] Assignee: Ricoh Company, Ltd., Japan

[21] Appl. No.: 884,208

[22] Filed: Jul. 9, 1986

[30] Foreign Application Priority Data

| | | | |
|---|---|---|---|
| Jul. 10, 1985 | [JP] | Japan | 60-153124 |
| Aug. 2, 1985 | [JP] | Japan | 60-170668 |
| Dec. 17, 1985 | [JP] | Japan | 60-194848[U] |

[51] Int. Cl.[4] ..... G03G 15/01; B05C 11/00

[52] U.S. Cl. ..... 118/691; 118/694; 118/652; 118/645; 118/603; 118/661; 137/397; 137/563; 355/4; 355/10

[58] Field of Search ..... 355/4, 10; 354/324, 354/298; 118/694, 603, 645, 652, 661, 690, 691, 693; 137/393, 397, 563

[56] References Cited

U.S. PATENT DOCUMENTS

| | | | |
|---|---|---|---|
| 3,129,115 | 4/1964 | Clark et al. | 118/652 X |
| 3,651,782 | 3/1972 | MacDonald, Jr. | 118/694 X |
| 3,663,100 | 5/1972 | Itoh et al. | 355/4 |
| 3,701,337 | 10/1972 | Borelli et al. | 118/652 |
| 4,024,885 | 5/1977 | Linthout | 137/393 X |
| 4,193,683 | 3/1980 | Langner | 355/10 |
| 4,449,475 | 5/1984 | Schinke | 118/652 X |
| 4,627,705 | 12/1986 | Landa et al. | 118/645 X |
| 4,640,605 | 2/1987 | Ariyama et al. | 118/645 X |

FOREIGN PATENT DOCUMENTS

| | | | |
|---|---|---|---|
| 0026137 | 3/1978 | Japan | 355/4 |
| 0111069 | 7/1983 | Japan | 355/10 |

*Primary Examiner*—Shrive Beck
*Assistant Examiner*—Alain Bashore
*Attorney, Agent, or Firm*—Mason, Fenwick & Lawrence

[57] ABSTRACT

A device applicable to an electrophotographic color copier or a color ink jet printer for selectively supplying visualizing liquids of different colors, e.g. black, red, green and blue or a mixture thereof to a photoconductive drum, paper or like recording medium to form a visible image on the medium which corresponds to an image of an original document. The device includes a black liquid vessel, a red liquid vessel, a blue liquid vessel, and a cleaning liquid vessel. The liquids from the various vessels are selectively fed to the device and, after a visualizing operation or a cleaning operation, selectively returned to the respective vessels by two switching units. Residual toner particles are returned to the black liquid vessel. A purifying member for capturing toner or like visualizing agent which is contained in the black liquid is situated between an overflow port of the black liquid vessel and the other liquid vessels and cleaning liquid vessel. Each of the liquid vessels other than the black and cleaning vessel is provided with an overflow port at a slightly higher level than a liquid level upper limit thereof, an effluent vessel communicating to those overflow ports. Another effluent vessel is communicated to the overflow port of the black liquid vessel.

39 Claims, 18 Drawing Sheets

| |
|---|
| FIG. 4D-1 |
| FIG. 4D-2 |
| FIG. 4D-3 |

DEVELOPING DEVICE FOR ELECTROPHOTOGRAPHIC COLOR COPIER

BACKGROUND OF THE INVENTION the present invention relates to a recording apparatus for forming a visible image on a photoconductive drum, paper or like recording medium by using a liquid developer of black or like single color or liquid developers of a plurlity of chromatic colors such as red, green and blue. More paticularly, the present invention is concerned with an arrangement for preventing the monocolor developer or the multi-color developers from overflowing containers in which they are accommodated.

Typical recording apparatuses of the kind described includes an electrophotographic color copier and a color ink jet printer. Considering an electrophotgraphic color copier, for example, one type of conventional ones is constructed and arranged to selectively supply liquid developers of different colors, e.g., black, red, green and blue to a single developing unit, as disclosed in Japanese Patent Publication No. 54-43898. In this type of semi-moist process color copier, as in a monochromatic semi-moist process copier, there are installed a diluent vessel for causing a diluent to automatically flow down into each developer vessel when a liquid level in the vessel is lowered, and a developer container for supplying the developer vessel with a high-concentration liquid developer by opening an electomagnetic valve when he concentration oft he liquid in the vessel is reduced.

Usually, the proportion of an image area to a non-image area on a document surface is very small. If follows that the developer (e.g. toner) is supplied to and consumed by a paper or a drum at a rate which is substantially equal to or lower than a rate at which the diluent is supplied to and consumed by a paper or a drum. In this condition, the developer vessel is prevented from overflowing even if supplied with the high concentration developer. Meanwhile, where an original document with solid content or a one with a high image rate is copied continuously, the toner consumption rate int he liquid developer is increased and, therefore, the concentration of the developer is sharply lowered. Such a decrease in the developer concentration needs be coped with by frequent supply of the developer which would increase the amount of developer in the vessel and, thereby, cause the developer to overflow the vessel. Once possible approach to prevent an overflow is using a sensing device sensitive to an upper limit of the liquid level and interrupting the operation of the copier as soon as the device senses the upper limit level. Such a sensor scheme, however, cannot be implemented without degrading the performance of the copier.

An electrophotographic color copier usually has a capability of producing a copy selectively in any of four different colors in total, e.g. black, red, green and blue and in a mixture of such colors. In this case, a black liquid developer is circulated from its associated vessel through a cleaning unit so as to clear the surface of a photoconductive drum of residual toners of the respective colors, the residual toners and black developer being collected and returned to the black developer vessel. In the event of changing the recording color, a cleaning liquid is fed to a developing unit to clean it and, then, a liquid developer of a specified color is supplied to the unit.

In the above-described construction wherein residual toners are collected by the cleaning unit to be returned to the black developer vessel with no regard to the recording colors, a grater amount of developers than a one which is consumed by development in black is returned to the black developer reservoir due to repetition of recordings in colors other than black. The resultant increase in the amount of developer in the vessel would cause the vessel to overflow. Needless to mention, where the frequency of producing a copy in black with a high image rate is relatively low while the frequency of producing copies in other colors each with a high image rate, it might occur that liquids of those other colors overflow their associated vessels.

Apparently, increasing the size of the various developer vessels is a possible implementation for settling the problematic situation as discussed above. This, however, would result in an increase in the dimensions of the whole apparatus.

SUMMARY OF THE INVENTION

It is therefore an object of the present invention to prevent a visualizing liquid from overflowing a vessel which is installed in a developing unit or like visualizing device of a recording apparatus.

It is another object of the present invention to detect levels of a visualizing liquid which is contained in a vessel of a developing unit or like visualizing device of a recording apparatus.

It is another object of the present invention to provide a generally improved developing device for an electrophotographic color copier.

A recording apparatus having a visualizing device which supplied a recording medium with visualizing liquids for recording information on the recording medium of the present invention comprises first visualizing liquid vessel means having a first vessel which contains a visualizing liquid of a first color and is provided with an overflow port, second visualizing liquid vessel means containing a visualizing liquid of a color which is different form the first color, first visualizing liquid supply means having a first visualizing liquid supply unit for supplying the visualizing liquid contained in the first first visualizing liquid vessel means to the visualizing device, second visualizing liquid supply means for supplying the visualizing liquid contained in the second liquid vessel means to the visualizing device, path switching means for selectively delivering any of the visualizing liquids discharged from the visualizing device to the first and second visualizing liquid vessel means, a purifier interposed between the overflow port of the first visualizing liquid vessel means and the second visualizing liquid vessel means for capturing developing agents which are contained int he visualizing liquids, color commanding means for commanding a color in which a recording is to be made, state monitoring means for monitoring a visualizing liquid supply state of the visualizing device, and a liquid supply control for referencing a color commanded by the color commanding means and a visualizing liquid supply state monitored by the state monitoring means and, if a color of the visualizing liquid in the visualizing device is different from the commanded color, commanding any of the first and second supply means corresponding to the commanded color a supply of the visualizing liquid while commanding the path switching means a delivery to the supply means which corresponds to the commanded color.

In accordance with the present invention, a device applicable to an electrophotographic color copier or a color ink jet printer selectively supplies visualizing liquid of different colors, e.g. black, red, green and blue or a mixture thereof to a photoconductive drum, paper or like recording medium to form a visible image on the medium which corresponds to an image of an original document. The device includes a black liquid vessel, a red liquid vessel, a blue liquid vessel, and a cleaning liquid vessel. The liquids from the various vessels are selectively fed to the device and, after a visualizing operation or a cleaning operation, selectively returned to the respective verses by two switching units. Residual toner particles are returned to the black liquid vessel. A purifying member for capturing toner or like visualizing agent which is contained in the black liquid is situated between an overflow port of the black liquid vessel and the other liquid vessels and cleaning liquid vessel. Each of the liquid vessels other than the black and cleaning vessel is provided with an overflow port at a slightly higher level than a liquid level upper limit thereof, an effluent vessel communicating to those overflow ports. Another effluent vessel is communicated to the overflow port of the black liquid vessel.

The above and other objects features and advantages of the present invention will become more apparent from the following description taken with the accompanying drawings.

BRIEF DESCRIPTION OF THE DRAWINGS

FIGS. 4A, 4A-1, 4A-2, 4B, 4C, 4C-1, 4C-2, 4D, 4D-1, 4D-2, 4D-3, 4E, 4F and 4G are flowcharts demonstrating controls which are assigned to a microprocessor included in the system of FIG. 3;

DESCRIPTION OF THE PREFERRED EMBODIMENTS while the developing device for an electrophotographic color copier of the present invention s susceptible of numerous physical embodiments, depending upon the environment and requirements of use, substantial numbers of the herein shown and described embodiments have been made, tested and used, and all have performed in an eminently satisfactory manner.

Figure 1:
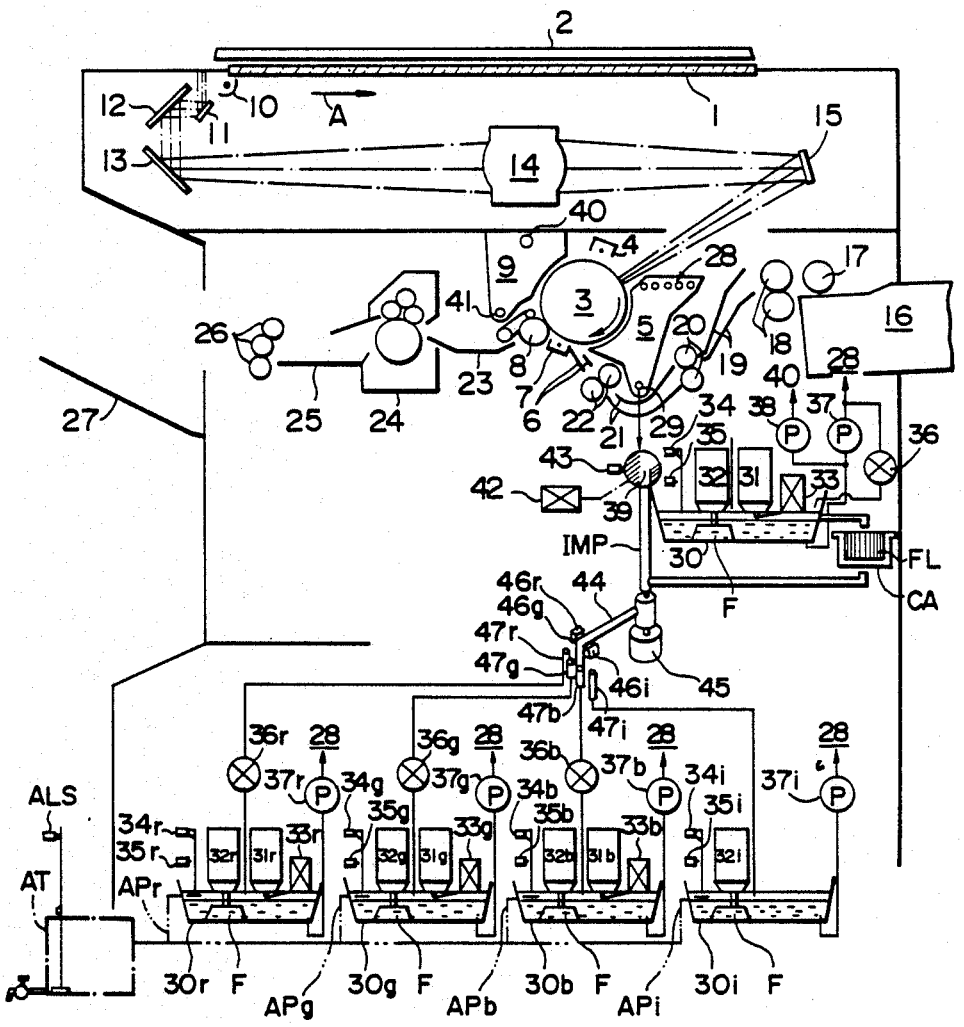
FIG. 1 is a block diagram showing an electrophotographic color copier to which the present invention is applied.

Referring to FIG. 1 of the drawings, a mono-color electrophotographic copier to which the present invention s applied is shown. The copier includes a glass platen 1 on which an original document (not shown) is laid and pressed by a pressure plate 2 from above. The document is illuminated by a lamp 10. Reflected light from the document is focused on the surface of a photoconductive drum 3 through an optical path including a fist mirror 11, a second mirror 12, a third mirror 13, a lens unit 14, and a fourth mirror 15. The drum 3 is adapted to be driven for rotation the clockwise direction by a main motor, not shown, the rotation of which is transmitted through a power transmission mechanism, not shown. Both the lamp 10 and the first mirror 11 are mounted on a first carriage, not shown, which is in turn driven at a uniform speed in a direction indicated by an arrow A. The second mirror 12 and the third mirror 13 are both mounted on a second carriage, not shown, which is adapted to be driven in the same direction at a speed which is equal to one-half that of the first carriage.

The surface of the drum 3 is uniformly charged by a main charger 4. The charged surface is exposed imagewise, whereby an electrostatic latent image is formed on the surface of the drum 3. The laten image is converted into a visible image by utilizing a liquid developer in a developing unit 5. At a transfer charger 7, the visible image is transferred onto a record paper which is payed off from a cassette 16 by a feed roller 17 and conveyed by conveyor roller pairs 18 and 20 and a pair of registering rollers 22 along paper guides 19, 21 and 6. The record paper carrying the visible image therewith is separated from the drum 3 by the action of a separator unit 8, and is fed along a paper guide 23 into a fixing unit 24 where it is heated by a heater, not shown. Subsequently, the record paper is conveyed along a paper guide 15 and delivered by a pair of delivery rollers 26 onto a delivery tray 27. The drum surface is cleaned by a cleaning unit 9.

The control of the energization of the described mechanical elements before the initiation of a copying operation, during a copy cycle and during an end cycle is well known for a monochromatic (black) recording copier and certain types of full color copier.

Figure 2A:
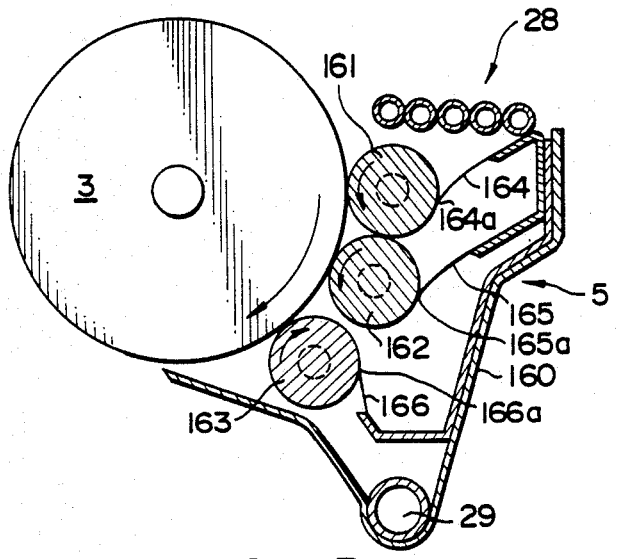
FIG. 2A is a section showing an internal arrangement of a developing unit as shown in FIG. 1.

The internal construction of the developing unit 5 is shown in FIG. 2A. As shown, the unit 5 includes an inlet 28 through which a liquid developer and a cleaning liquid are supplied, and an outlet 29 through which the liquid developer and the cleaning liquid are discharged. It includes a container 160 in which a first developing roller 161, a second developing roller 162 and a squeezing roller 163 are mounted in a rotatable manner. These rollers are made of an electroconductive material and slightly spaced from the surface of the drum 3. Both the rollers 161 and 162 are driven for rotation counter clockwise while the roller 163 is driven for rotation clockwise. All the rollers 161 to 163 are maintained rotating while the drum 3 is in rotation, and are at rest when the drum 3 is stationary. The rollers 161, 162 and 163 are respectively engaged by the free end of scrapers 164, 165 and 166 which act to scrape any developer attaching to the roller surface therefrom. Both the scrapers 164 and 165 are effective to maintain a pool of either liquid developer or cleaning liquid as it comes down from above. The liquid in the pool wets the surface of the rollers 161 and 162. The liquid on the surfaces of the rollers 161 and 162 are transferred onto the drum 3 under the influence of the electric charge on the drum surface 3. The roller 163 serves to remove any excess amount of liquid from the drum surface.

Figure 2B:
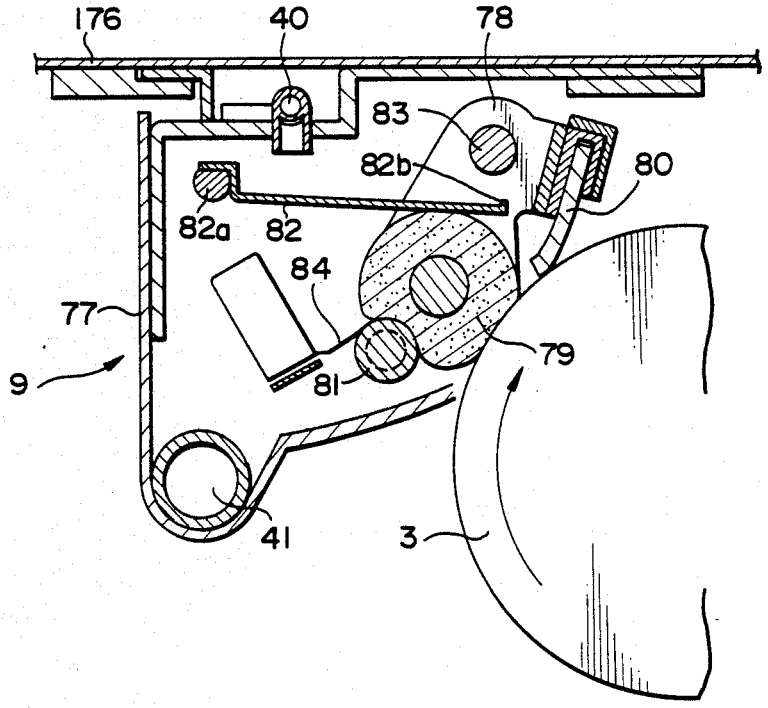
FIG. 2B is a section showing an internal arrangement of a cleaning unit as shown in FIG. 1.

FIG. 2B shows the interior of the cleaning unit 9. It includes a container 77 which is mounted on a support arm 176 which is integral with a frame, not shown, of the copier. A bracket 78 is pivotally mounted on a shaft 83 which is secured to the frame of the copier. A blade 80 is fixedly mounted on one end of the bracket 78 while a sponge roller 79 is pivotally mounted on the other end of the bracket 78. The shaft 83 is coupled to the plunger of a solenoid assembly, not shown, so that during the rotation of the drum 3 the solenoid assembly is energized to rotate the blade 80 and the roller 79 forcibly into abutment against the drum 3. However, when the drum 3 is at rest, the solenoid assembly is deenergized, and a return spring, not shown, acts to rotate the bracket 78 clockwise about the shaft 83, thus moving the blade 80 and the roller 79 away from the drum 3 and also freeing the roller 79 from compression by a squeegee roller 81.

The squeegee roller 81 is rotatably mounted on the frame of the copier, and is contacted by a scraper 84, whereby the liquid as scraped by the sponge roller 79 is moved through the roller 81. A receiver dish 82 is fixedly mounted on a shaft **82*a* which is in turn pivotally mounted on the frame of the machine, and bears against the roller 79 by gravity. An inlet 40 is disposed in the top end of the container 77 while an outlet 41 is disposed at the bottom hereof. A black liquid developer from a black developer vessel (first vessel) 30 is supplied to the unit 9 by means of a pump 38. In this manner, a liquid developer containing black toner is supplied to the unit 9 as a cleaning liquid. As it is fed through the inlet 40, the black liquid developer flows down upon the dish 82 and flows threrealong to drip down on the drum 3 from the free end 82*b*. The liquid 30 together with the liquid developer which has flown down to between the drum 3 and the roller 79 from the free end 82*b***.

Referring again to FIG. 1, the inlet 28 of the developing unit 5 includes a plurality of ports, which are coupled through a plurality of pipes, not shown, to discharge ports of a first pump 37, a second pump **37*r*, a third pump 37*g*, a fourth pump 37*b* and a pump 37*i* associated with a cleaning liquid, respectively. The outlet 29 of the developing unit 5 is coupled to the inlet of a flow path switching valve 39. The outlet of the switching valve 39 is selectively switched to a common flow path IMP communicating to a nozzle 4 and the first vessel (black liquid developer vessel) 30. The switching valve 39 is coupled to a two position switching mechanism, not shown, which is driven by a solenoid assembly 42. As shown in FIG. 1, which is driven 29 of the switching valve 39 is connected to the common flow path IMP (nozzle 44), one energization of the solenoid assembly 42 causes the two position switching mechanism to drive the switching valve 39 counterclockwise, whereby the outlet 29 of the valve 39 is connected to the first vessel 30. One energization of the solenoid assembly 42 when the outlet 29 is connected to the first vessel 30 causes the two position switching mechanism to drive the switching valve 39 clockwise to connect the outlet 29 of the switching valve 39 to the common flow path IMP (nozzle 44). In this manner, each time the solenoid assembly 42 is energized, the switching valve 39 rotates from one of its positions to the other or reversely. A position detecting switch 43 is mounted on the valve 39, and assumes a closed condition when the outlet 29 is connected to the common flow path IMP while it assumes an open condition when the outlet 29 is connected to the first vessel 30**.

The nozzle is rotatably carried by a pulse motor 45. Thus, the nozzle 44 represents another switching means, and recovery pipes (**57*r*, 47*g* and 47*b*) are disposed below the outlet of the nozzle 44 with liquid guides, not shown, interposed therebetween. When the outlet of the nozzle 44 is located right above the pipe 47*r*, the liquid flowing out of the nozzle 44 enters a second vessel (red liquid developer vessel) 30*r*. When the outlet of the nozzle 44 is located above the pipe 47*g*, the liquid flowing out of the nozzle 44 enters a third vessel (green liquid developer vessel)30*g*. When the outlet of the nozzle 44 is located above the pipe 47*b*, the liquid flowing out of the nozzle 44 enters a fourth vessel (blue liquid developer vessel) 30*b*. Further, when the outlet of the nozzle 44 is located above the pipe 47*i*, the liquid flowing out of the nozzle 44 enters a cleaning liquid vessel 30*i*. Such positions of the nozzle 44 are detected by position detecting switches 46*r*, 46*g*, 46*g* and 46*i*, respectively. It is to be noted that the switches 46*r*, 46*g*, 46*b* and 46*i* assume a closed position when the outlet of the nozzle 44 is closed above the pipe 47*r*, pipe 47*g*, pipe 47*b* or pipe 47*i*, respectively. Any of these switches is open when the nozzle 44** is not located at a corresponding position.

As mentioned previously, the pump 38 supplies the black liquid developer from the vessel 30 to the inlet of the cleaning unit 9. The black liquid developer flowing out the outlet 29 of the unit 9 is returned to the first vessel 30 through a piping, not shown.

The first vessel (black liquid developer vessel) 30, second vessel (red liquid developer vessel) **30*r*, third vessel (green liquid developer vessel) 30*g* and fourth vessel (blue liquid developer vessel) 30*b* have a black liquid developer container 31, a red liquid developer container 31*r*, a green liquid developer container 31*g* and a blue liquid developer container 31*b*, respectively, as well as diluent containers 32, 32*r*, 32*g* and 32*b*, respectively, mounted therein. The containers 31, 31*r*, 31*g* and 31*b* are coupled to solenoid assemblies 33*r*, 33*g*, 33*b* and 33*i*, respectively, through links. When an associated solenoid assembly is energized, the opening of a corresponding liquid developer container is opened to allow the liquid developer contained therein to flow down. The nozzle end of a mouthpiece of each of the diluent containers 32, 32*r*, 32*g* and 32*b* abuts against a support plate disposed within the respective vessels 30, 30*r*, 30*g* and 30*b* to be raised with respect to the container, whereby the opening of the container opens into the vessel. When the liquid level within the vessel is lowered, the diluent is discharged into the vessel form the container. Only a cleaning liquid container 32*i* is mounted within the cleaning liquid vessel 30*i*. the nozzle end of the mouthpiece of the container 32*i* bears against a support plate disposed within the vessel 30*i* and is upturned with respect to the container, whereby the opening of the container opens into the vessel. As the level of the cleaning liquid within the vessel 30*i* is lowered, the cleaning liquid is discharged into the vessel 39*i*** from the container.

The firsts vessel 30, second vessel **30*r*, third vessel, fourth vessel 30*b* and cleaning liquid vessel 30*i* are provided with floats F responsive to rises and falls of their associated liquid levels, upper limit detecting switches 34, 34*r*, 34*g*, 34*b* and 34*i*, respectively, which are responsive to upper limit positions of the floats F, and lower limit detecting switches 35, 35***r*, 35*g*, 35*b* and 35*i*, respectively, which are responsive to lower limit positions of the floats F. An overflow port is formed in the first vessel 30 which contains the black liquid developer at a location slightly higher than the liquid level at which the upper limit detecting switch 34 will be closed, the overflow port being connected to a liquid inlet of a purifier unit CA, which has a liquid outlet thereof communicated to the common flow path IMP.

Figure 2C:
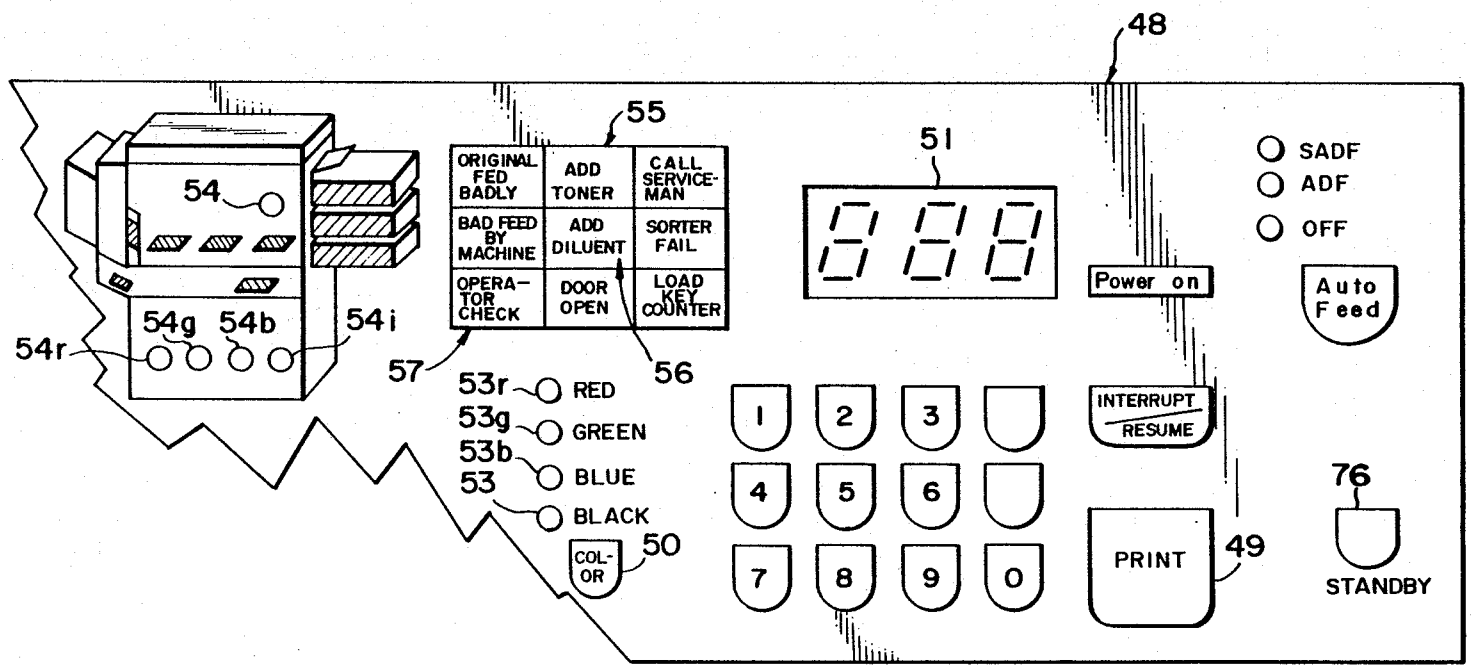
FIG. 2C is a plan view of a part of an operating board.
Figure 2D:
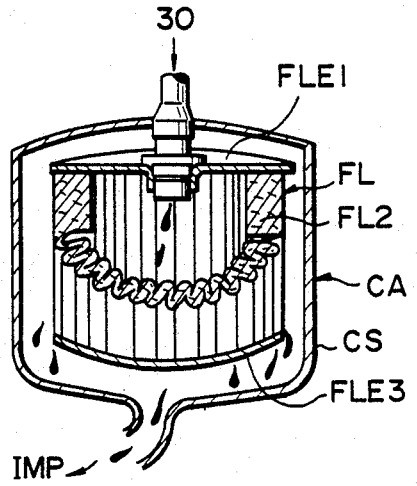
FIG. 2D is a section showing an internal arrangement of a purifier as shown in FIG. 1.

Referring to FIG. 2D, the internal construction of the purifier unit CA is shown. Specifically, the purifier unit CA includes a cup-shaped outer container (CS) in which a hollow filter cartridge FL is received. The filter cartridge FL comprises an upper disk FLE1 having a mouthpiece to which a pipe communicating to the overflow port in the firsts vessel is secured, a sleeve FLE2 having a meandering construction in order to increase the filtering area, and a lower disk FLE3, all of which are secured together to be liquid tight. All of these members FLE1, FLE2 and FLE3 are formed of a filter material which blocks the passage of a toner in the liquid developer while allowing the passage of a solvent of diluent. As the liquid developer from the first vessel 30 passes through the purifier unit CA, the liquid developer enters the inside of the filter cartridge FL, whereupon only the toner within the liquid developer is trapped by the filter while allowing the solvent or diluent to pass through the filter cartridge to the outside of the container (CS), and thence flowing to the common flow path IMP and through the nozzle 44 to either the second vessel 30*r*, third vessel 30*g*, fourth vessel 30*b* or cleaning liquid vessel 30*i*. When the filter cartridge FL becomes plugged to present an increased resistance to a flow of the solvent or diluent therethrough, the liquid level of the liquid developer in the first vessel 30 rises after the filter cartridge FL has been filled with the liquid developer, thus operating the upper limit detecting switch 34, which then becomes closed. In this manner, the closure of the switch 34 indicates a plugging of the filter cartridge FL and an excess of the liquid developer in the first vessel. The probability that the liquid developer flows from the first vessel to the purifier unit CA will be high when there is a high frequency of recording in either red, green or blue, when an increased number of copies each having a high solid content are produced to increase the amount of liquid developer which is recovered from the cleaning unit 9 into the first vessel 30, or when a black recording is made with a high proportion of solid material, requiring an increased supply of liquid developer into the first vessel 30 from the developer container 31. Because these are normally rare occurrences, the probability that the liquid developer finds its way through the filter cartridge FL is very low and, therefore, a very long period of use is available until a plugging of the filter cartridge FL occurs. Where it is desired to increase the length of time which is available until a plugging occurs, a material which exhibits a high toner adsorbing capability such as activated charcoal, ion exchange resin or the like in powder, granular or filamentary form may be contained within the filter cartridge FL. This would reduce the amount of toner which is trapped on the inner wall of the filter cartridge, thus reducing the likelihood of occurrence of a plugging.

Figure 3:
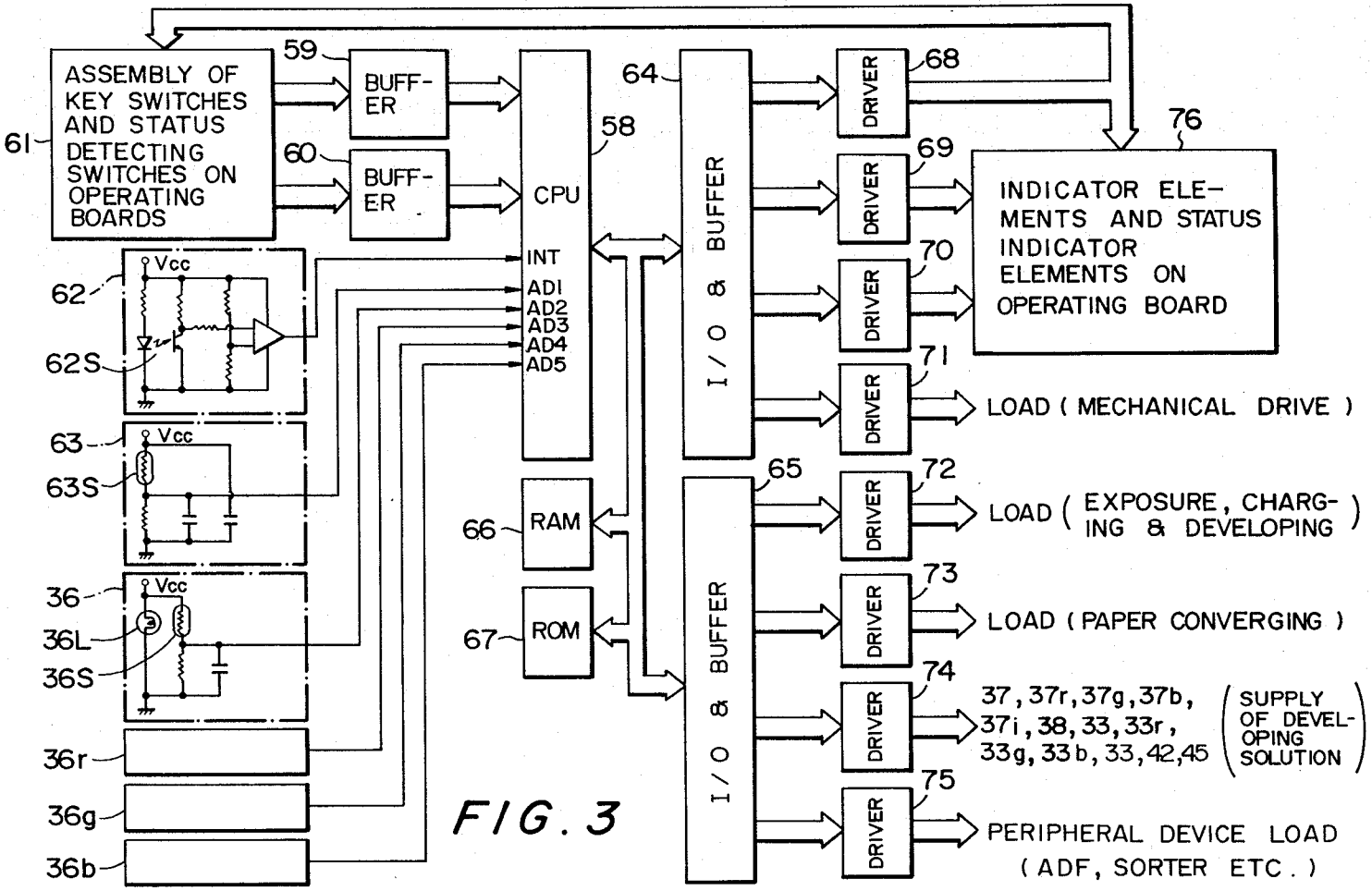
FIG. 3 is a block diagram showing an electrical control system.

A liquid which is discharged rom the first pump 37 is partly returned to the first vessel 30 through a first concentration detector unit 36 where the concentration of the black liquid developer is detected. A second concentration detector unit 36*r* is disposed in the pipe 47*r* which returns the liquid developer to the second vessel 30*r*; a third concentration detector unit 36*g* is disposed in the pipe 47*g* which returns the liquid developer to the third vessel 30*g*; and a fourth concentration detector unit 36*b* is disposed in the pipe 47*b* which returns the liquid developer to the fourth vessel 30*b*. Each of these detector units 36, 36*r*, 36*g* and 36*b* comprises a channel through which a liquid developer is caused to flow in the form of a thin film, and a combination of a lamp (36L in FIG. 3) and a photoelectric transducer (36S in FIG. 3) which are disposed in opposing relationship with each other on the opposite sides of the thin film of liquid developer. The arrangement of such an electrical circuit is shown in FIG. 3. It is to be noted that the detector units 36, 36*r*, 36*g* and 36*b* are constructed in an identical manner in their electrical arrangement.

Figure 2E:
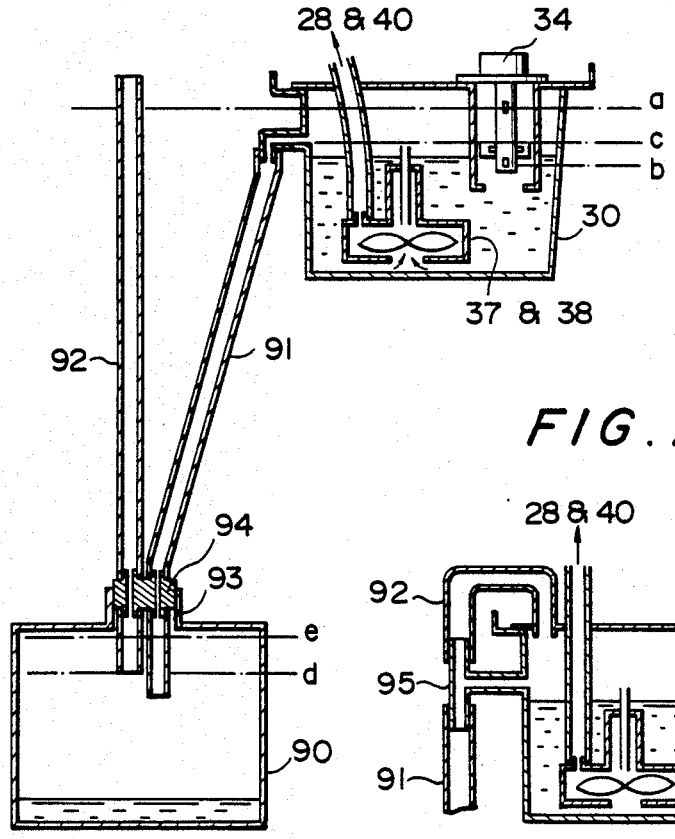
FIG. 2E is a section of an overflow tank adapted to receive a liquid developer which overflows a black developer vessel of FIG. 1.

The first vessel (black liquid developer vessel) 30 as discussed above is provided with, in addition to the purifier CA, an overflow tank 90 which is adapted to receive the liquid developer which overflow the vessel 30, as shown in FIG. 2E. The overflow tank 90 is removably installed together with the second to the fourth vessels 30*r*, 30*g* and 30*b* and cleaning liquid vessel 30*i* in the inside of a base which is adapted to support the copier body. The relationship between the overflow tank 90 and the first vessel 30 is shown in FIG. 2E. As shown, a discharge conduit 91 which is implemented with a hose extends into the interior of the overflow tank 90 from an intermediate point c on a side wall of the vessel 30 between an upper limit a and a lower limit b of liquid level. An air vent conduit 92 which is also implemented with a hose extends upwardly from the tank 90 to a level above the upper limit a, the lower end of the conduit 92 being located at a level d inside the tank 90. The conduits 91 and 92 are supported together by a plug 94 which is adapted to close a mouth 93 of the tank 90. In this construction, when the plug 94 is removed from the tank 90, the liquid developer reached the upper limit level a is prevented from overflowing the tank 90 although it may flow down into the tank 90 through the conduit 91.

Figure 2F:
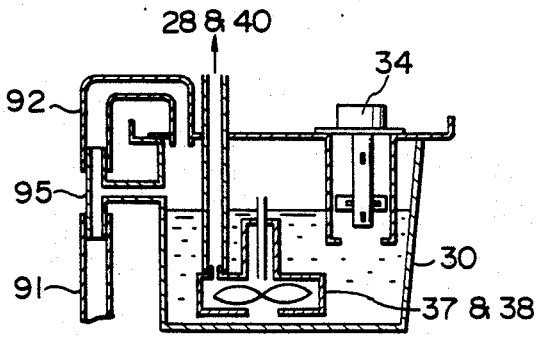
FIG. 2F is a section showing a modification of the overflow tank of FIG. 2E.

It is needless, however, for the air vent conduit 92 to rise directly from the overflow tank 90. Alternatively, as shown in FIG. 2F, the conduit 92 may be connected to an upper connecting end of a T-elbow 95 which protrudes from the side wall of the first vessel 30. Further, where the first vessel 30 is constructed as a hermetically closed vessel, the upper end of the conduit 92 may be communicated to the inside of the vessel 30 from the top of the latter, as shown in FIG. 2F. In this particular embodiment, the upper limit detecting switch 34 is implemented with a non-contact type switch which is made up of a float magnet and a magnetic sensor. The pumps 37 and 38 are installed in the first vessel 30.

As long as the drum 3 is rotating, the rollers 161, 162 and 163 in the developing unit 5 rotate also and the bracket 8 of the cleaning unit 9 is disposed at the location shown in FIG. 2*b* where the blade 80 and the sponge roller 79 abut against the drum 3. The pump 38 is energized to supply the black liquid developer to the cleaning unit 9.

When a black recording mode is established, the switching valve 39 assumes a position in which it connects the outlet 29 to the first vessel 30, and the pump 37 is energized to supply the black developing solution the developing unit 5. When a red recording mode is established, the switch valve 39 assumes another position in which the outlet 29 is connected to the nozzle 44, which is then located so as to be disposed above the pipe 47*r*, and the pump 37*r* is energized to supply the red liquid developer to the unit 5. When a green recording mode is established, the switching valve 39 assumes a position in which the outlet 29 is connected to the nozzle 44, which is then located so as to be disposed above the pipe 47*g*, and the pump 37*g* is energized to supply the green liquid developer to the unit 5. When a blue recording mode is established, the switching valve 39 assumes a position in which the outlet 29 is connected to the nozzle 44, which is then located to be disposed above the pipe 47*b*, and the pump 37*b* is enerized to supply the blue liquid developer to the unit 5.

When changing from the black to the red recording mode, the first pump 37 is deenergized, and the switching valve 39 is switched to the nozzle 44 after a liquid drain-off time $T_1$ for the liquid developer, and the nozzle is located above the pipe 46*i*. The pump 37*i* is energized for a cleaning time interval $t_2$. Upon the lapse of the time interval $t_2$, the pump 37*i* is deenergized, and at a drain-off time $T_1$ for the cleaning liquid subsequent to the deenergization, the nozzle 44 is brought to a position above the pipe 47*r*, and the pump 37*r* is energized.

A change from a black to a green or a blue recording mode takes place in a similar manner. A change from one of the red, green and blue recording modes to another one of them also takes place in a similar manner, but in this instance, the switching valve 39 is not changed.

When changing form one of the red, green and blue recording modes to the black recording mode, either one of the red, green and blue liquid developers will be mixed with the black liquid developer, but the record is made in the black color. Accordingly, to reduce a switching time which is required to establish the black recording mode which represents the mode of the highest frequency of use, the switching valve 39 is changed to the first vessel 30 as the pump 37*r*, 37*g* or 37*b* is energized, and the first pump 37 is energized. There is no supply of the cleaning liquid to the developing unit 5. This allows the drain off time $T_1$ for the developing solution, the cleaning time interval $t_2$ and the drain-off time $T_1$ for the cleaning liquid to be omitted. However, no copying operation is initiated for a time interval $t_5$ which begins with the energization of the first pump 37 and continues until the black developer is sufficiently supplied to all the rollers 161, 162 and 163 of the unit 5.

Referring to FIG. 2C, there is shown a part of an operating board 48 which is installed on the copier of FIG. 1.

Elements shown in FIG. 2C will be described in the following:

76: Standby command switch with a light emitting element built therein. After a power switch, not shown has been turned on, turning the switch 76 on when light emitting element thereof is not illuminated causes the element to be illuminated. This establishes a standby mode of the copier, and a fixing heater is energized for heating to a low temperature. If the switch 76 is turned when the light emitting element thereof is illuminated, the element will be extinguished, and the copying machine enters a condition in which it waist for a copy command. The fixing heater is energized for heating to an elevated temperature.

49: A copy start switch with a red light emitting element and a green light emitting element built therein. The green light emitting element is illuminated when the copying machine is capable of effecting a copying operation while it waits for a copy command. If the switch 49 is turned on under this condition, a copy cycle is initiated. As the copy cycle is initiated, the red light emitting element is illuminated. The red light emitting element remains illuminated for the duration of a copying opertion which produces a given number of copies entered. When the copying operation to produce the given number of copies has been completed, the red element is extinguished while the green element is illuminated. During and after the copying operation, when the copying machine assumes a condition in which no copying operation is enabled, the green element is extinguished while the red element is illuminated.

SADF: Light emitting element which becomes illuminated when a semi-automatic feeder is mounted on the copier.

ADF: Light emitting element which becomes illuminated when an automatic feeder is mounted on the copier.

OFF: Light emitting element which is illuminated when no feeder is mounted.

Auto Feed: An auto-feed command switch internally housing a light emitting element. When this switch is turned on, the light emitting element internally housed therein becomes illuminated, and the copying machine is enabled to establish an automatic feed mode in which an original document is automatically fed from a feeder which is mounted on the copier onto the glass platen 1. If this switch is turned when the light emitting element is illuminated, the element is extinguished and a normal mode is established for the copying machine in which an original document is manually placed on the glass platen 1.

Power On: Power indicator lamp. This lamp is illuminated when a power switch, not shown, is turned on, and is extinguished when the power switch is off.

Interrupt/Resume: An interrupt command switch with a light emitting diode housed therein. If this switch is turned on when the light emitting element is extinguished, data relating to the setting of the operating board 48 and copying data relating to the copier (e.g. number of copies already produced) are saved in a memory, and a copy command waiting condition is established with the number of copies preset to 1 (one). This condition allows the setting of the operation board 48 to be changed as desired to command the production of a copy (interrupted copy mode). If this switch is turned when its light emitting element is illuminated, data which has been saved in a memory is read out to preset the operating board 48 according to such data. Internal data of the copier such as the number of copies which have already been produced is re-loaded.

51: Three digit character display. This indicates the number of copies to be produced before a copying operation is initiated, and indicates the number of copies produced after the initiation of a copying operation. It also indicates any abnormality.

0 to 9: Numerical key switches which are used for the entry of the number of copies to be produced and other information.

Clear: A switch which, when operated, cancels the entry made by the numerical keys including the number of copies to be produced.

Recall: A switch which commands a read-out of saved data relating to the setting of the operating board.

55: A light emitting element which indicates the depletion of a developing solution, and which is illuminated when either one of the lower limit detecting switch, 35, 35*r*, 35*g* or 35*b*, is closed.

56: A light emitting element which indicates the depletion of a cleaning liquid and which becomes illuminated when the lower limit switch 35*i* is closed.

57: A light emitting element which indicates the need of a check operation and which is illuminated when either the upper or the lower switch is closed and upon occurrence of any abnormality such as a paper jamming or mechanical failures.

53, 53*r*, 53*g*, 53*b*: Selected color indicator lamps: Selected color indicator lamps. When the power switch is turned on, the lamp 53 is illuminated to establish a black recording mode.

50: A color command switch. The closure of this switch when the lamp 53 is illuminated causes the lamp 53 to be extinguished while allowing the lamp 53*b* to be illuminated, thus setting up a blue recording mode. The closure of the switch 50 when the lamp 53*b* is illuminated causes the lamp 53*b* to be extinguished while allowing the lamp 53*g* to be illuminated, thus setting up a green recording mode. The closure of the switch 50 when the lamp 53*g* is illuminated causes the lamp 53*g* to be extinguished while allowing the lamp 53*r* to be illuminated, thus establishing a red recording mode. Finally, the closure of the switch 50 when the lamp 53*r* is illuminated causes the lamp 53*r* to be extinguished while allowing the lamp 53 to be illuminated, thus establishing a black recording mode.

54: A first vessel trouble indicator lamp which is illuminated when either upper or lower limit position detecting switch 34 or 35 is closed or when the container 31 is empty.

54*r*: A second vessel trouble indicator lamp which is illuminated when either upper or lower limit position detecting switch 34*r* or 35*r* is closed or when the container 31*r* is empty.

54*g*: A third vessel trouble indication lamp which is illuminated when either upper or lower limit position detecting switch 34*g* or 35*g* is closed or when the container 31*g* is empty.

54*b*: A fourth vessel trouble indicator lamp which is illuminated when either upper or lower limit position detecting switch 34*b* or 35*b* is closed or when the container 31*b* is empty.

54*i*: A cleaning liquid vessel trouble indicator lamp which is illuminated when either upper or lower limit position detecting switch 34*i* or 35*i* is closed or when the container 31*i* is empty.

Hatched areas around the indicator lamp 54 are representative of spots which are illuminated by a paper jamming indicator lamp. It is to be noted that other switches and indicator elements are mounted on the operating board 48.

Referring to FIG. 3, there is shown an electrical system which operates to energize various elements and components of the copier as shown in FIG. 1. An assembly of switches 61 including entry switches, status detecting switches and status establishing switches associated with various parts of the copier are connected through buffer amplifiers 59 and 60 to a microprocessor (CPU) 58, and are also connected to a drive 68. The CPU 58 includes an interrupt input port IN which is connected to a drum synchronized pulse generator 62. The pulse generator 62 includes a photosensor 62S which detects a light transmitting slit formed in a rotary plate which is coupled to the photosensitive drum 3. The sensor detects a light transmitting slit for each incremental angle of the rotation of the drum 3, and delivers a single pulse to the interrupt input port INT. The CPU 58 also includes an analog-to-digital (A/D) conversion input port AD1 which is connected to a temperature detector circuit 53 which operates to detect the temperature of an active area of the fixing unit 24. A thermistor 63S develops a voltage which corresponds to the temperature of the active area for application to the port AD1. The CPU 58 also includes A/D conversion input ports Ad2, Ad3, Ad4 and Ad5 which are connected to the developer concentration detector units 36, 36*r*, 36*g*, and 36*b*, respectively. A photoelectric transducer element 36S develops a voltage which corresponds to the concentration of a black liquid developer which is pumped by the first pump 37, for application to the port AD2. A lamp 36L illuminates the photoelectric transducer element 36S through a thin film of liquid developer. It is to be understood that the electrical circuit of the units 36*r*, 36*g* and 36*b* is constructed in the same manner as that of the unit 36, and these electrical circuits deliver voltages corresponding to the concentration of the red, green and blue developers to the ports AD3, AD4 and AD5, respectively.

The CPU 58 is connected to a read only memory (ROM) 67, a random access memory (RAM) 66 and input/output port buffer elements 64, 65 through an address bus, a control bus and a data bus. The input-/output port buffer elements 64 and 65 are operatively connected to drivers 68 to 71 and drivers 72 to 75, respectively.

The driver 68 sequentially applies a switch status read signal to each of Y scan lines of the switch matrix 61, and also sequentially applies an indicator element energize signal to each of Y scan lines of an indicator element matrix 76. In response, a signal appearing on each of X lines of the switch matrix 61 and indicating the open or closed condition f each switch is fed through the buffers 59 and 60 to the CPU 58. If necessary, the CPU 58 applies an indicator element energize signal to each of X lines of the indicator element matrix 76 via the buffer 64 and drivers 69 and 80. It is to be understood that any indicator element within the matrix 76 to which the indicator energize signal on the Y line and the indicator energize signal on the X line are applies simultaneously is illuminated.

The drier 71 is operatively connected to mechanical drive elements such as main motor, clutch or the like, not shown; the driver 2 is operatively connected to electrical elements such as lamp 10, chargers 4 and 7 or the like which are involved with a formation of an image; the driver 73 is operatively connected to electrical elements such as clutch, motor or the like, not shown, which are involved with conveying the paper; the drive 74 is operatively connected to electrical elements in a system which supply a liquid developer, namely, the pumps 38, 37, 37*r*, 37*g*, 37*b* and 37*i*, solenoid assemblies 42, 33, 33*r*, 33*g*, 33*b* and pulse motor 45; and the driver 75 is connected with connectors associated with electrical components which are mounted on the copying machine such as a feeder, sorter or the like.

The CPU 58 applies various energize signals to the drivers 68 to 75 in accordance with an entry operation of various switches and in accordance with the status of the various parts of the copier.

A control operation by the CPU in a copier is known in various forms. Accordingly, a control operation by the CPU 58 will be described principally in connection with the implementation of the present invention.

Figures 1, 4A:
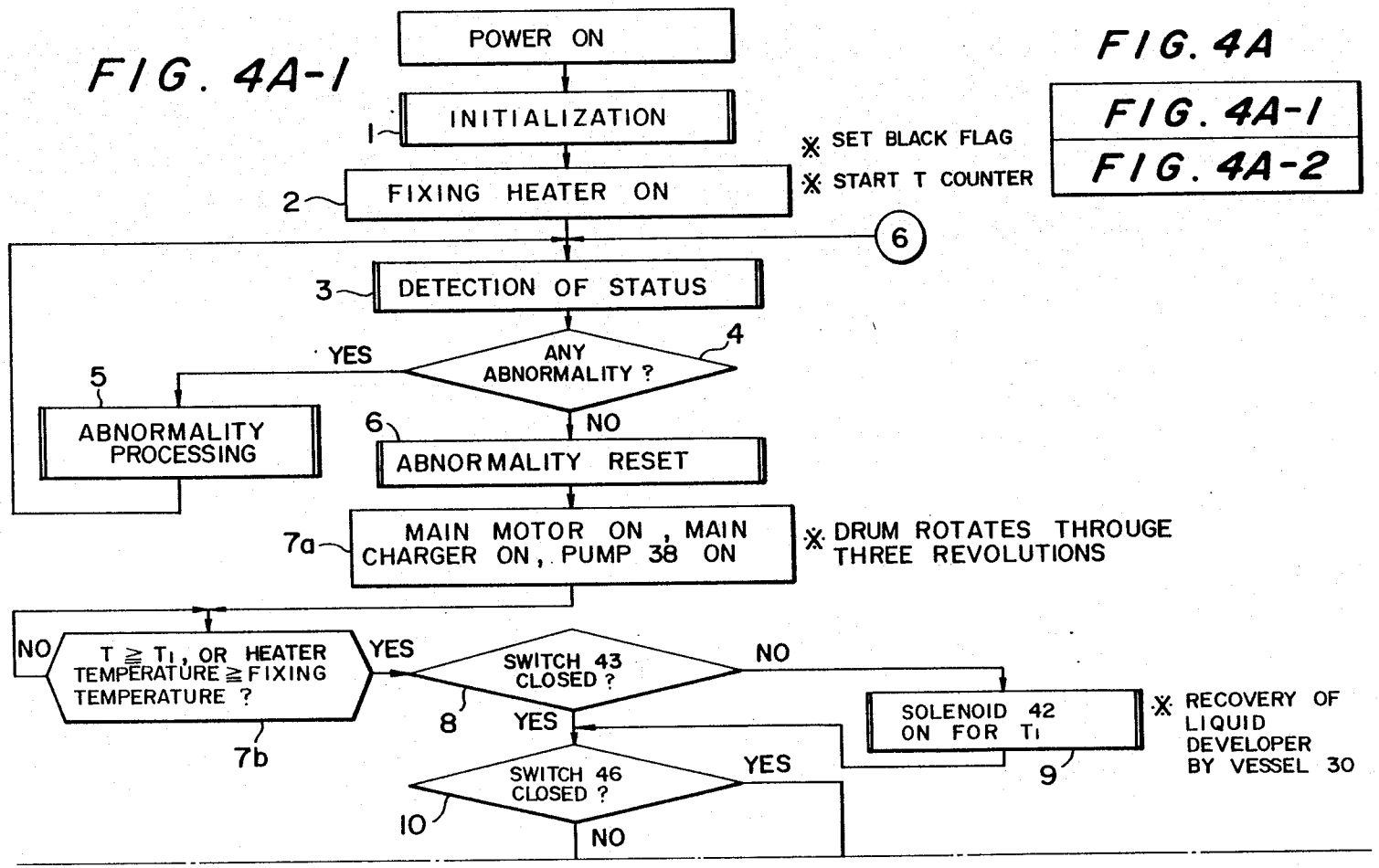
Figures 2, 4A:
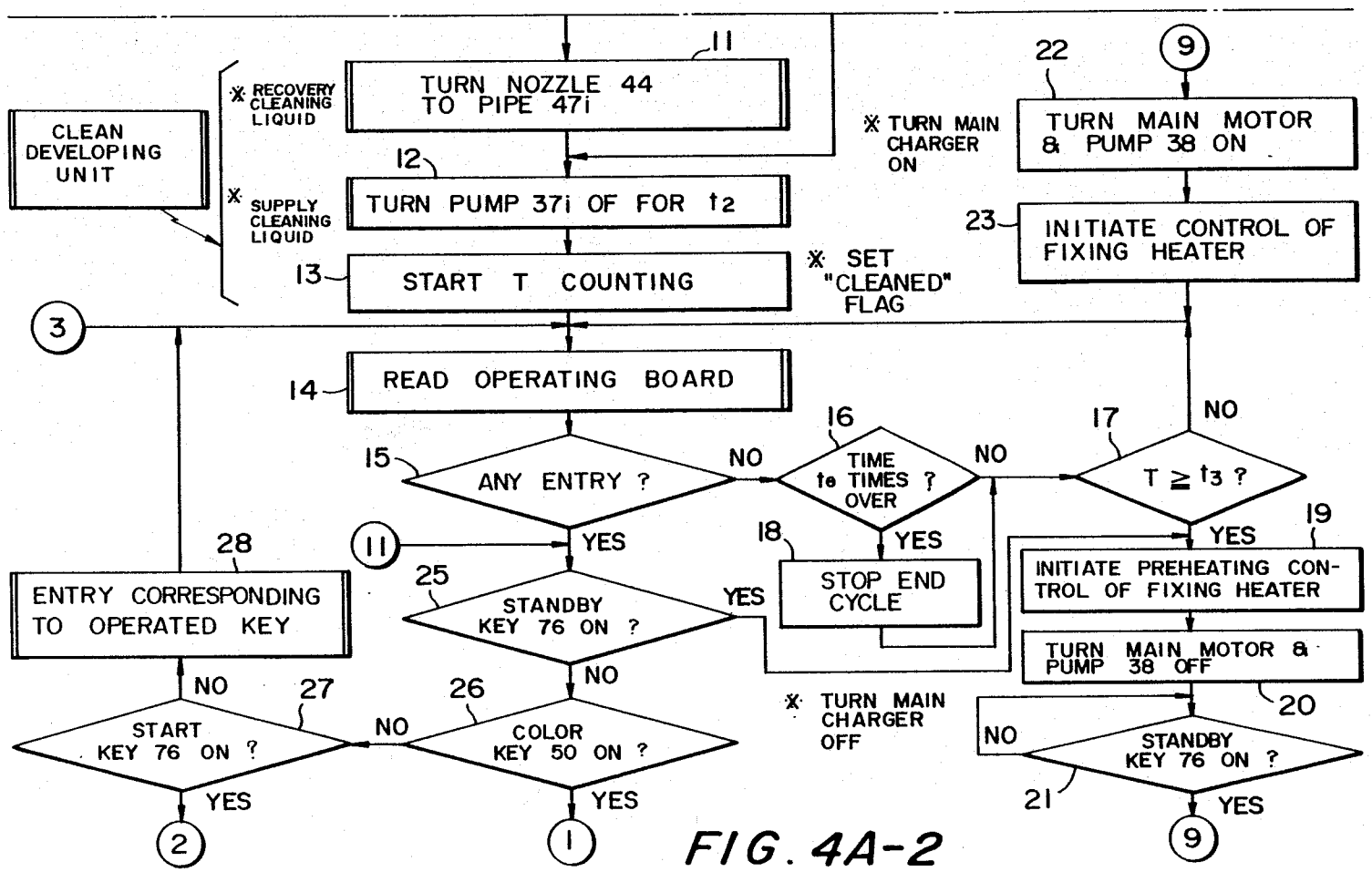

Initially referring to FIG. 4A, when a power switch, not shown, of the copier is turned on to feed power to the CPU 58 as well as various parts of the copier, the CPU 58 effects an initialization (step 1). During the initialization step 1, every element within the copier is reset to its inoperative condition, and internal counter, timer and register within the CPU 58 are initialized. Also, status tracking registers which are allocated within RALM are initialized. The display on the operation board 58 is set up in its standard condition while storing data indicative of a selected mode in a memory. In the standard condition, the number of copies to be produce is equal to 1 (one), and the color selected is black (indicator lamp 53 being illuminated). In this manner, the indicator lamp 53 is illuminated and a black flag is set. A counting of a time interval T is started.

Upon completion of the initialization, the CPU 58 commands a heater driver, which is effective to energize a heater within the fixing unit 24, for energization to produce a heating at an elevated temperature (step 2). If then checks the status detecting switches within the switch matrix 61 to determine the presence of any abnormality within the arrangement (step 3). If any abnormality is found, the CPU 58 performs an abnormality processing (steps 4 and 5) and waits for the machine to resume a normal condition (a loop around steps 3, 4, 5 and 3). If it is found that the machine is in its normal condition or if the normal condition is restored, the CPU 58 clears an abnormality flag and abnormality indication (step 6), turns a main motor on to cause the drum 3 to rotate through thee revolutions, and also turns the pump 38 on to supply the black liquid developer to the cleaning unit 9 (step 7*a*). In response to the energization of the main motor and the pump, the developing rollers 161 to 163 are driven for rotation within the developing unit 5, and the main charger 4 is energized. A bias voltage of the same polarity as that of the toner is applied to the developing rollers. The purpose of energizing the charger and applying the bias voltage is to attract any toner contained in the developer present on the surface of the developing rollers 161 to 163 onto the drum 3 for recovery into the unit 9. The bracket 78 is driven simultaneously and moves to the position shown in FIG. 2B, whereby the blade 80 and the sponge roller 79 are brought into abutting relationship against the drum 3 (step 7*b*).

The CPU 58 then examines if the time T is equal to or greater than the drain-off time $T_1$ and, then, the temperature of the active area within the fixing unit 24 (output of 63S) (step 7*b*). If the time T is less than $T_1$ and the temperature of the active area within the unit 24 is less than a preselected fixing temperature, it enters a standby mode, waiting for the time T to exceed $T_1$ or for the temperature of the active area to exceed the preselected temperature (step 7*b*). When the time T is equal to or greater than $T_1$, a drain-off operation within the developing unit 5 has been conducted satisfactorily and, if the temperature of the active area is equal to or greater than a preselected fixing temperature, a copying operation is enabled. Accordingly, in order to allow the developing unit 5 to be cleaned, the CPU 58 initially examines the status of the switch 43 (steps 8), and if it is not closed or if the outlet 29 of the unit 5 is connected to the first vessel 30, it energize the solenoid assembly 42 for a time interval $t_1$ (step 9). This changes the switching valve 39 to connect the outlet 29 to the nozzle 44, whereby the switch 43 is closed.

Figure 4B:
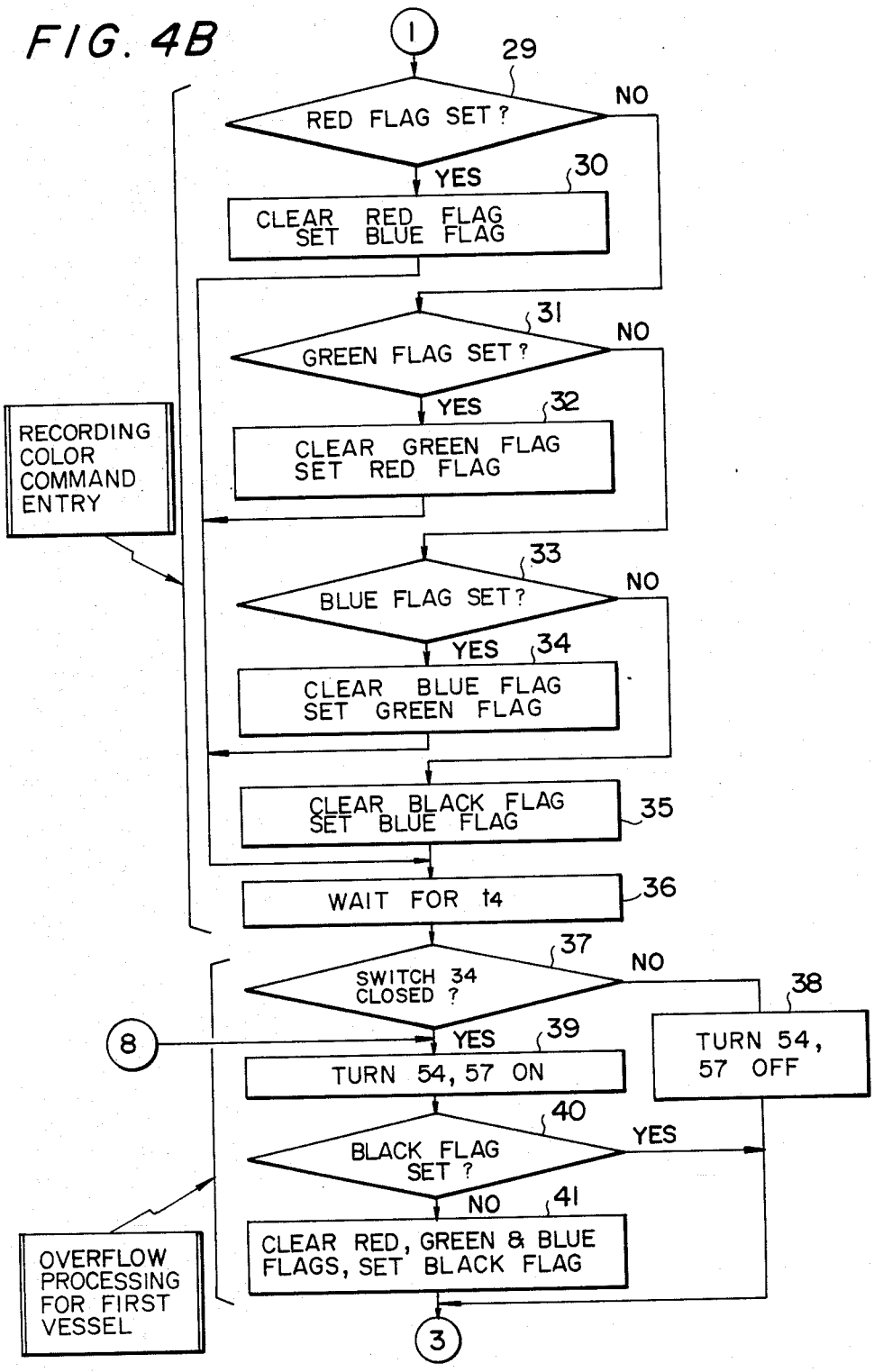

If the switch 43 is closed or is changed into a closed condition, the program proceeds to a step 10 shown in FIG. 4*b* where the CPU 58 examines the status of the nozzle position detecting switch 46*i*. If the switch 46*i* is not closed, this means that the nozzle 44 is not located above the pipe 47*i*. Accordingly, the status of other switches 46*r*, 46*g* and 46*b* are examined, and the pulse motor 45 is energized for rotation in the reverse direction to locate the nozzle 44 above the pipe 47*i* (step 11). After such positioning, or when the nozzle 44 is located above the pipe 47*i*, the pump 37*i* is energized for a time interval $t_2$ which defines a cleaning period for the developing unit 5, thus cleaning it for such a time interval (step 12). During the cleaning period $t_2$, the cleaning liquid from the vessel 30*i* is supplied to the unit 5 and is then recovered by the vessel 30*i*. When the cleaning period $t_2$ expires, the time T begins to be counted, setting "cleaned" flag (step 13). In other words, a counting of a time interval which is used to determine that the cleaning drain-off time $T_1$ has elapsed is initiated.

What has been described above relates to the control of supply of a liquid developer immediately after the power switch is turned on, or an initialization control of the developing unit 5.

When the cleaning operation (step 12) has been completed, the CPU 58 reads the status of the operating board 48 (step 14). If there is no entry to the operating board 48, the program loops around steps 16, 17 and 14, waiting for any entry to the operating board 48. The program also waits for an end cycle termination time $t_e$ to elapse and also for a key-in standby time $t_3$ to elapse. The time $t_e$ represents an end cycle execution time which causes the drum 3 to rotate for the purpose of post-processing after a copying operation has been initiated an a final copy has been produced. The end cycle is initiated upon completion of production of the final copy, by starting a timer $t_e$ (program timer) having a time limit $t_e$, and the program then returns to the step 14. A step 16 examines to see if the time limit of the timer $t_e$ of the timer $t_e$ has been passed over. If the time limit is over or if the end cycle is completed, the end cycle is stopped (step 18). The key-in standby time $t_3$ establishes a time interval after which the machine is automatically returned to its standby condition if there is no entry to the operating board after an entry for a copying operation is enabled (step 14).

When the time T reaches a count $t_3$ after an entry for the copying operation s enabled (step 12 and a copying operation for a preset number of copies has been completed) (step 17), the CPU 58 changes the fixing heater to a preheat energization (hating at a reduced temperature), illuminates the light emitting element associated with the standby switch 76 (step 19), stops the main motor and the pump 38, and deenergizes the main charger 4 (step 20). The copier then enters a standby condition in which it waits for the standby switch 76 to be turned on (step 21). If the standby switch 76 is turned on at time other than the standby mode, this fact is detected at the step 14, whereby the program proceeds from a step 25 to the step 19, entering a standby mode. When the standby switch 76 is turned on during the standby mode (step 21), the main motor, main charger and pump 38 are energized (step 22) in the similar manner as in the step 7*a*, and the fixing heater is energized for heating at an elevated temperature (step 23) in the same manner as in the step 2. At the step 14, when keys switches other than the standby switch 76, color selection switch 26 and start key switch 49 are being read (step 27), an entry corresponding to an opertion key is made (step 28). A typical entry is the selection of a number of copies to be produced, which is entered by numeral keys.

When the color command switch 50 is operated by way of example, the CPU 58 proceeds from the step 26 of FIG. 4A to the recording color command entry and the overflow processing for the vessel 30 of FIG. 4B. Referring to FIG. 4B, assuming that the switch 50 is turned on for the first time immediately after the power switch has been turned on, the indicator element 53 is illuminated, and a black flag is set in a register of the CPU 58 or in a register of the Ram 66 during the initialization at the step 1. Accordingly, the processing operation by the CPU 58 proceeds through steps 29, 31, 33 and 35, and it clears the black flag at a step 35 to extinguish the light emitting element 53, sets a blue flag to illuminate the light emitting element 53*b*, and then waits for a time interval $t_4$ to pass in order to prevent a doubled reading of a single switch operation (step 36). After performing the overflow processing for the vessel 30 which is represented by the steps 37 to 41, the program returns to the reading of the operating board shown in FIG. 4A (step 14).

If the color command switch 50 is operated when the blue flag is set, the processing operation by the CPU 58 proceeds though the steps 29, 31, 33 and 34, and it clears the blue flag at the step 34 to extinguish the light emitting element 53*b* and sets the green flag to illuminate the light emitting element 53*g* and then waits for a time interval $t_4$ to expire (step 36). After the overflow processing for the black liquid developer vessel 30 which is represented by the steps 37 to 41, the program returns to the reading of the operating board shown in FIG. 4*b* (step 14).

When the color command switch 50 is operated when the green flag is set, the processing operation by the CPU 58 proceeds through the steps 29, 31 and 32, and it clears the green flag at the step 32 to extinguish the light emitting element 53*g* and sets the red flag to illuminate the light emitting element 53*r*, and then waits for the time interval $t_4$ elapses (step 36). After the overflow processing for the black liquid developer vessel 30 which is represented by the steps 37 to 41, the program returns to the reading of the operating board shown in FIG. 4*b* (step 14).

When the color command switch 50 is operated when the red flag is set, the CPU 58 proceeds through steps 29 and 30, and clears the red flag to extinguish the light emitting element 53*r* and sets the black flag to illuminate the light emitting element 53 at the step 30, and then waits for the time interval $t_4$ to pass (step 36). After the overflow processing for the black developer vessel 30 which is represented by the steps 37 to 41, the program returns to the reading of the operation board of FIG. 4A (step 14). If the color command switch 50 is maintained on continuously, the indicator elements 53, 53 *b*, 53*g* and 53*r* are sequentially illuminated at a time interval substantially equal to $t_4$ in the sequence named. Accordingly, a continuous on or an intermittent on condition of the color command switch 50 is capable of specifying one of black, blue, green and red.

When the CPU 58 proceeds to the overflow processing (steps 37 to 41) for the black developer vessel 30 after reading the recording color command (steps 29 to 36), it initially examines the status of the switch 34 (step 37). As mentioned previously, during the time the drum 3 is rotating, including the duration of the copying operation, the pump 38 supplies the black liquid developer to the cleaning unit 9, and the liquid discharged from the unit 9 is collected by the first vessel 30. During a black recording operation, the black liquid developer is supplied from the vessel 30 to the developing unit 5 and the cleaning unit 9, from which the liquid is recovered by the first vessel 30. Accordingly, the quantity of liquid developer within the first vessel 30 does not substantially increase normally, but rather decreases as a result of the copying operation. However, during the blue, green or red recording operation, a considering the red recording operation, for example, the red liquid developer is supplied from the second vessel 30*r* to the developing unit 5, and the discharged liquid is recovered by the vessel 30*r*. However, any amount of red liquid developer which attaches to the drum 3 and is recovered by the cleaning unit 9 will be recovered by the first vessel 30, thus increasing the quantity of liquid therein. Hence, if the blue, green or red recording operation is performed when the switch 34 is closed indicating that the quantity of black liquid developer exceeds its upper limit, there may occur an overflow of the liquid developer from the first vessel 30.

when an overflow occurs, the black liquid developer passes through the overflow port to eh purifier CA. Accordingly, there is no substantial overflow from the first vessel 30 normally. However, in the event the filter sleeve FL of the purifier CA has been plugged to maintain a pool of liquid developer in the internal space within the filter sleeve FL, there is the possibility that an overflow actually occurs from the vessel 30. The overflow processing (steps 37 to 41) for the vessel 30 is provided as a control step which avoids the occurrence of such overflow beforehand. It also represents a control step which alarms a plugging of the filter sleeve FL, indicating the necessity to replace or clean the filter sleeve FL. Specifically, when the switch 34 is closed (step 37), indicating that the quantity of liquid within the vessel 30 exceeds the overflow port level, the first vessel trouble indicator lamp 54 and an operator check indicator lamp 57 are illuminated (step 39), and executes an abnormality processing (step 82) while disabling a copying operation, and returns to the detection of status (step 3), thus waiting for the switch 34 to resume its open condition representative of termination of a repair.

The switch 34 will be open when the operator reduces the quality of developing solution with the first vessel 30 and/or replaces the filter sleeve FL in response to the illumination of the indicator lamps 55 and 57. When the operator operates the switch 50 subsequently, the CPU 58 proceeds through the steps 14, 15, 25 and 26 and steps 37 and 38 of FIG. 4B, extinguishing the indicator lamps 54 and 57. If the switch 34 remains closed, the indicator lamps 54 and 57 remain illuminated and the red indicator lamp associated with the print key 49 remains illuminated, preventing a copying operation from being initiated.

Meanwhile, when the amount of liquid in the first vessel 30 is increased to reach a certain level c (FIG. 2E), the liquid developer flow down into the overflow tank 90 through the discharge conduit 91. The liquid level in the vessel 30 reaches the upper limit a together with the liquid level in the overflow tank 90 which increases beyond the level d to enter the air vent conduit 92, thereby closing the switch 34. In this condition, should a farther blue, green or red recording operation be performed, the liquid in the vessel 30 might overflow. Specifically, when the switch 34 is closed, indicating that the liquid level in the vessel 30 is higher than the upper limit (step 37), there is the possibility of an overflow and, moreover, repeating a black copy cycle in the above condition results in a sequential decrease in the density of reproduced images since no liquid developer is supplied from the black liquid developer container 31. To alert the operator to such an unusual situation, the CPU 58 turns on the first vessel trouble indicator lamp 54 and operator check indicator lamp 57 (step 39) and then sees if a black flag is set (step 40). Because initiating a copy cycle is no problem so long as a black flag is set (black record command), the program proceeds to reading of the operating board 48 (step 14: waiting for the start switch 49 to be turned on). However, if the black flag is not set, indicating a record command in another color, the CPU 58 clears all of the red, green and blue flags and, instead, sets the black flag, extinguishes the red, green and blue indicator lamps 53 *b*, 53*g* and 53*r* while illuminating the black indicator lamp 53 (step 41), and subsequently advances to the step 14.

Under the above condition, while the operator check lamp 57 is illuminated, a three-digits character display 51 may be driven to display the kind of abnormality mode thereon by symbols. Such would allow the operator to reference a card corresponding to the information displayed so as to take a necessary measure such as reducing the amount of liquid developer in the first vessel 30, and then effect a color recording operation manually.

Guided by the indicator lamps 55 and 57, the operator replaces the overflow tank 90 or discharges the liquid developer from the tank 90, thereby opening the switch 34. Thereafter, as the operator manipulates the switch 50, the CPU 58 goes through the steps 14, 15, 25 and 26 and the step of reading a recording color and steps of 37 and 38 of FIG. 4B to run off the indicator lamps 54 and 57. If the switch 34 remains closed, the indicator lamps 54 and 57 ar turned on and a black recording mode is established (black flag being set).

Figures 1, 2, 4C:
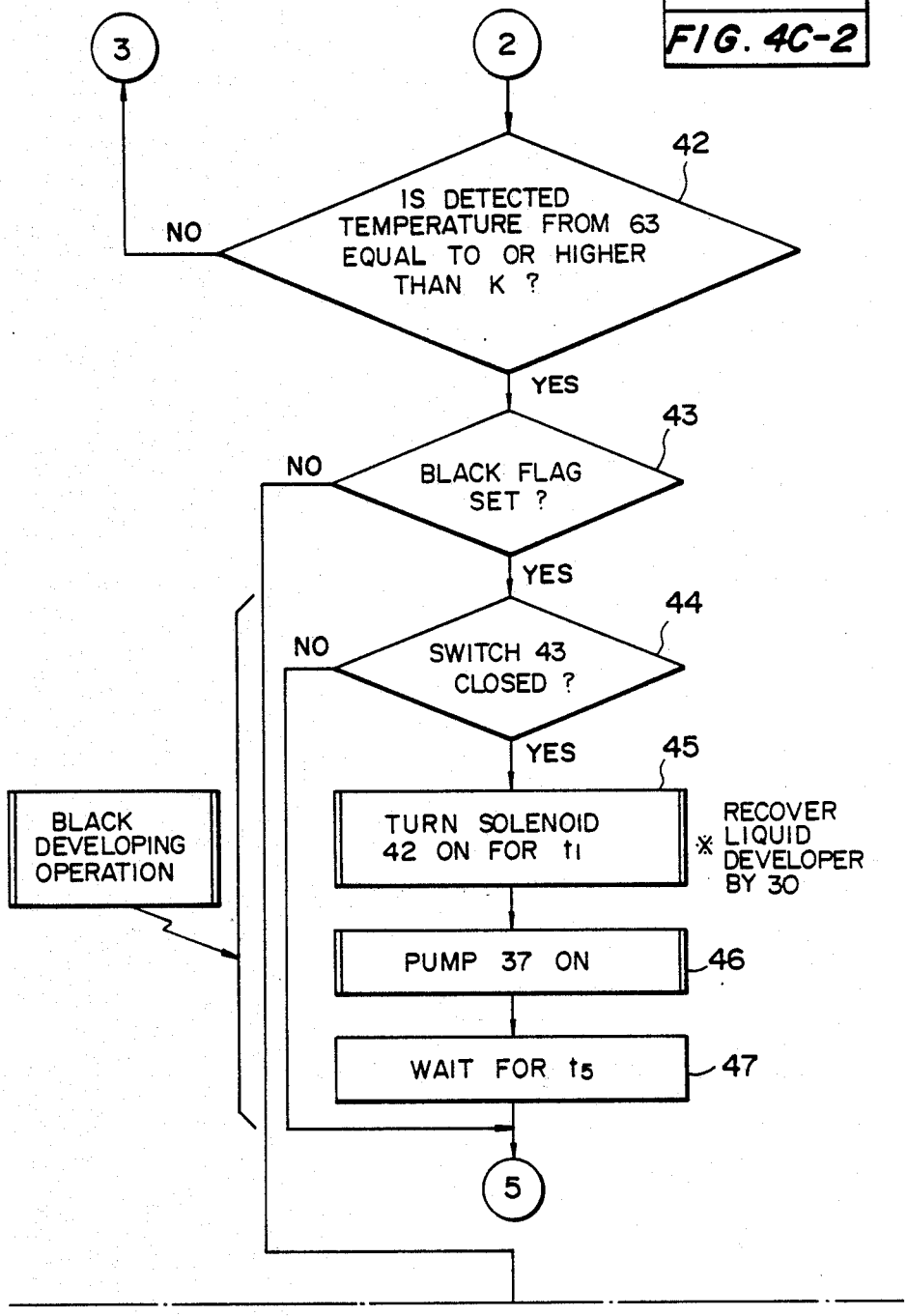
Figures 2, 4C:
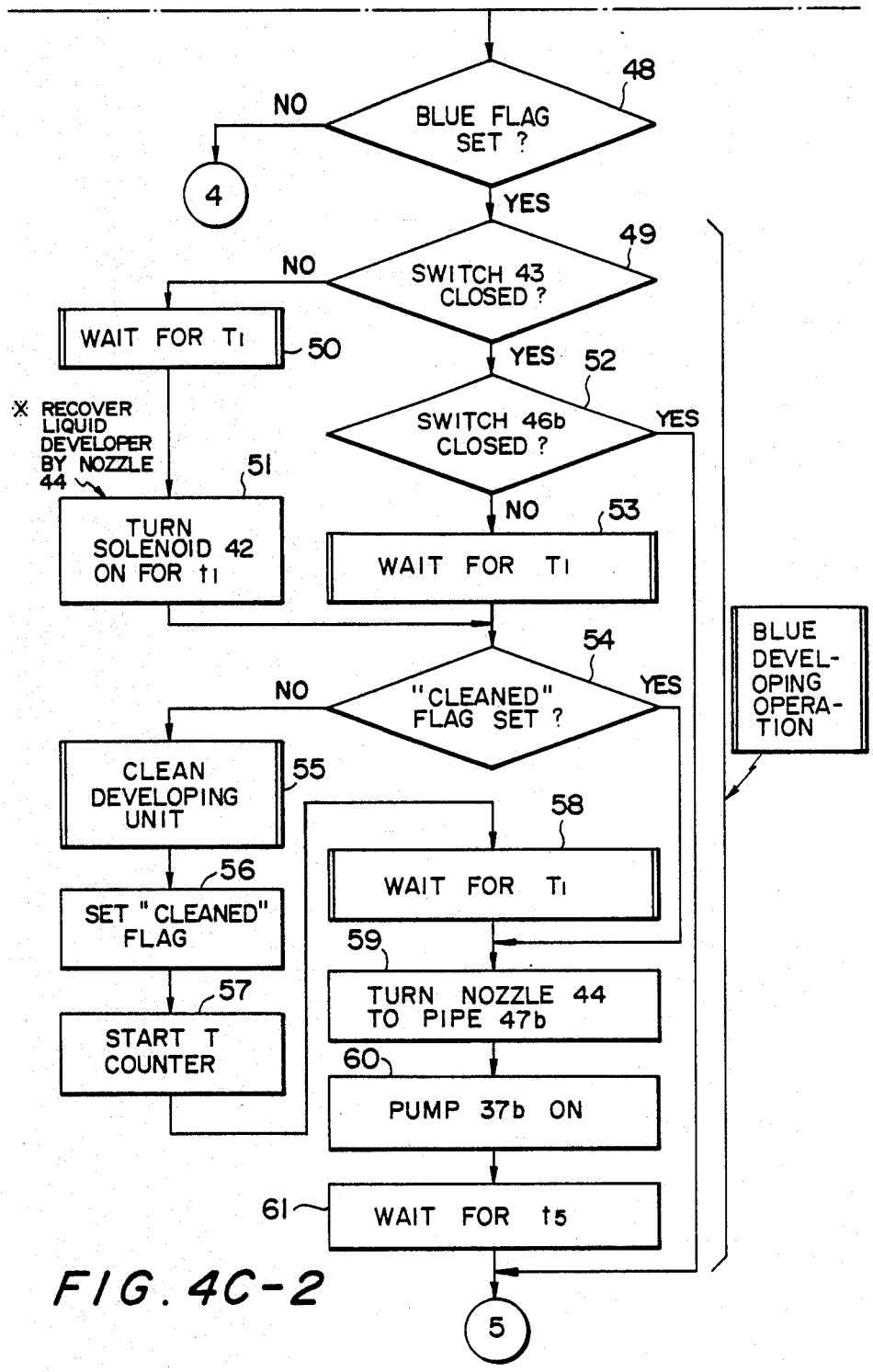

When the closure of the print start switch 49 is detected during the reading of the operating board (step 14 shown in FIG. 4A), the CPU 58 proceeds through the steps 15, 25, 26 and 27 to a step 42 as shown in FIG. 4C. At the step 42, the temperature of the active area of the fixing unit 24 is examined to see if it is equal to or greater than a preset fixing temperature K. If the actual temperature is less than K, the program returns to the reading of the operating board (step 14). It is to be noted that when the actual temperature is less then k, the red light emitting element associated with the start switch 49 is illuminated while when the actual temperature is equal to or grater than K, the green light emitting element will be illuminated, provided the copying machine is in a condition to read the operating board.

Figures 1, 4D:
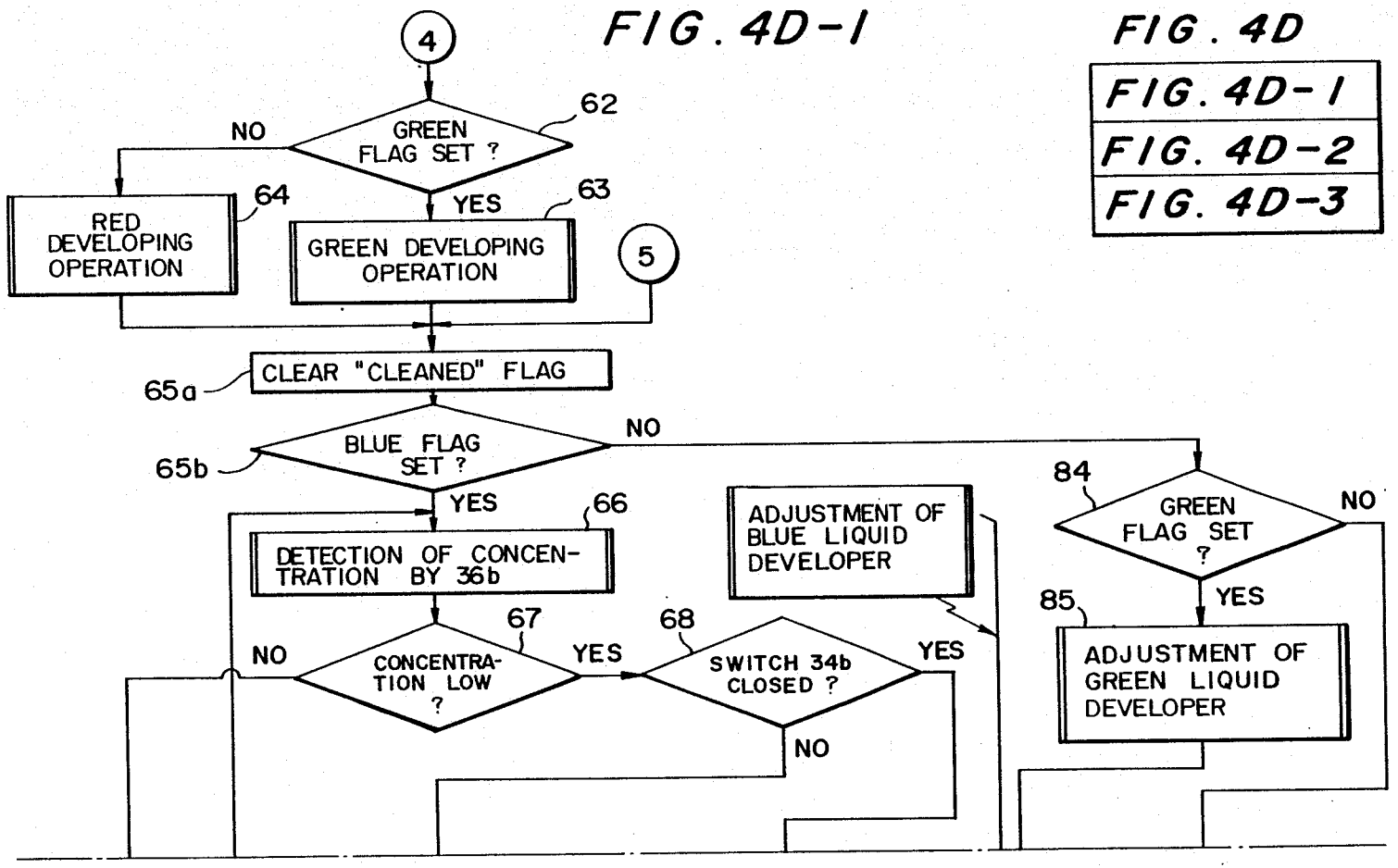
Figures 2, 4D:
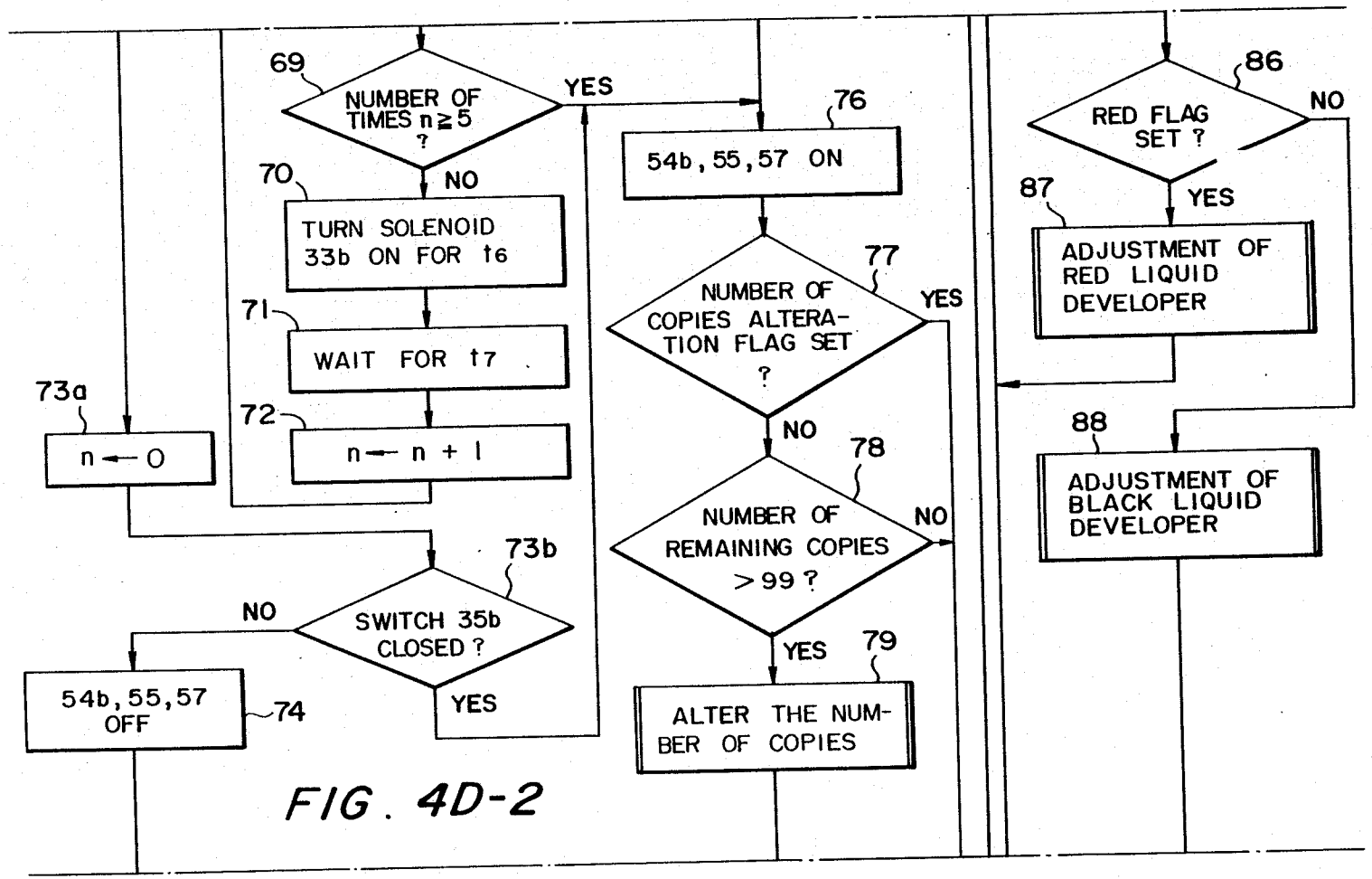
Figures 3, 4D:
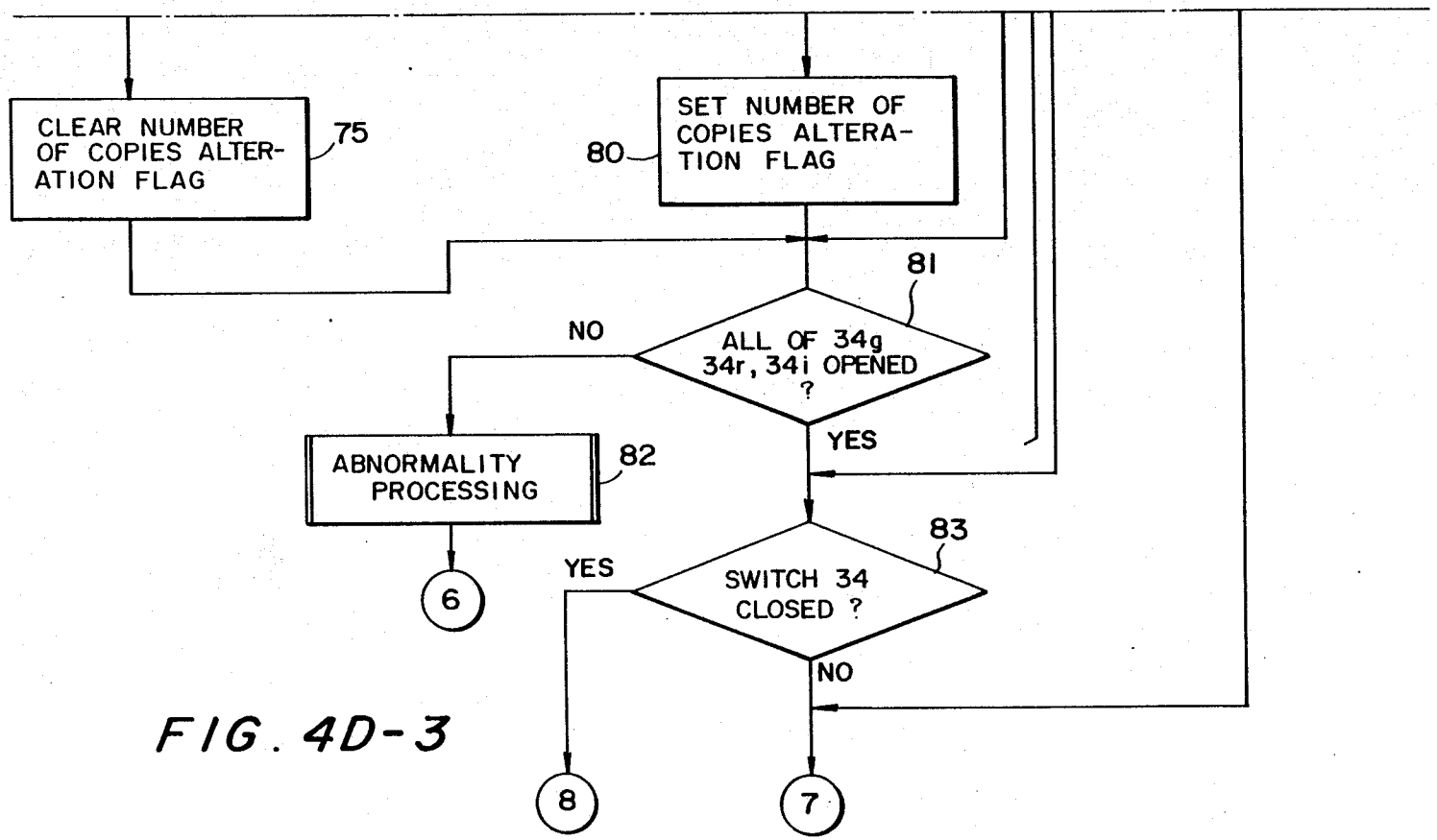

Assuming that the temperature of the active area of the fixing unit 24 is equal to or greater than K, the program proceeds from the step 42 to a step 43 where it examines if the black flag is set. If it is set, the program executes a set of steps 44 to 47 which performs a black developing operation. Specifically, the status of the switch 43 is initially examined. If it is not closed, this means that the switching valve 39 is located to pass the discharged liquid developer from the developing unit 5 to the first vessel 30 and, at this time, the program proceeds to an adjustment of the liquid developer shown in FIG. 4D. If the switch 43 is closed, the switching valve 39 is located to pass the discharged liquid from the unit 5 to the nozzle 44 so that the solenoid assembly 42 is energized for a time interval $t_1$ to change the switching valve 39 for connection with the first vessel 30 (step 45) so that the discharged solution is supplied to the first vessel 30, and also energizes the pump 37 (step 46). The program then waits for a time interval $t_5$ to elapse (step 47) in order to wait for the black liquid developer from the first vessel 30 to be sufficiently supplied to the rollers 161 to 163 of the unit 5. After the time interval $t_5$ has passed, the program proceeds to the adjustment of liquid developer as shown in FIG. 4D. It is to be noted than when the black developing operation s enabled, there is no waiting for the time $T_1$ which is required to achieve a drain-off of the liquid developer which was previously within the unit 5, the time interval $t_2$ which is required to supply the cleaning liquid to the unit 5 for cleaning it, and the time $T_1$ which is subsequently required to achieve a drain-off of the cleaning liquid.

When the black flag is not set, the program then examines if the blue flag is set (step 48). If the blue flag is set, the program executes a set of steps 49 to 61 which represent the blue developing operation. Specifically, the status of the switch 43 is examined (step 42), and if it is closed, the status of the switch 46*b* is examined (step 52). If both the switches 43 and 46*b* are closed, this means that the switching valve 49 is disposed for connection with the nozzle 44, which is located above the pipe 47*b*, allowing the discharged liquid from the developing unit 5 to be routed to the fourth vessel (namely, the blue liquid developer vessel). This implies that the immediately preceding copying operating was a copying operation in the blue color, and that a drain-off and a cleaning of the developing unit 5 is unnecessary. Accordingly, the program directly proceeds to the adjustment of liquid developer as shown in FIG. 4D. If the switch 43 is not closed, this means that the immediately preceding copying operation was performed in the black color, so that the program waits for the time $T_1$ which it required for a drain-off of the black liquid developer from the developing unit 5 to pass (step 50: details of such an operation is shown in FIG. 4F and will be described later), followed by a time interval $t_1$ during which the solenoid assembly 42 is energized to change the switching valve 39 for connection with the nozzle 44 (step 51) and then examines the "cleaned" flag (step 54).

When the "clceaned" flag is set, this means that the copier has now completed a cleaning operation for the developing unit. Accordingly, when the "cleaned" flag is set, the nozzle 44 is located above the pipe 47*b* (step 59), the pump 37*b* is energized (step 60), and the program waits for a time interval $t_5$ to expire (step 61) which is required to supply the blue liquid developer sufficiently to the rollers 161 to 163 of the unit 5. Upon the lapse of the time interval $t_5$, the program proceeds to the adjustment of liquid developer as shown in FIG. 4D. When it finds at the step 54 that the "cleaned" flag is not set, this signifies that the previous liquid developer supplied to the unit 5 has been either black, green or red, but that the blue liquid developer is not to be supplied, thus requiring a cleaning operation. Hence, the unit 5 is cleaned (step 55). It is to be noted that the cleaning operation performed at the step 55 is identical with the cleaning operation of the unit 5 performed at the steps 11 to 13 as shown in FIG. 4A. It is noteworthy that during the cleaning step 55 a counting operation to count the time T is started in the same manner as the step 13. Subsequently, the "cleaned" flag is set (step 56), and a counting of the time T is initiated (step 57), waiting for the time $T_1$ to pass (step 58). Details of "waiting for $T_1$ to pass" (steps 50, 53 and 58) are shown in FIG. 4F.

Figure 4E:
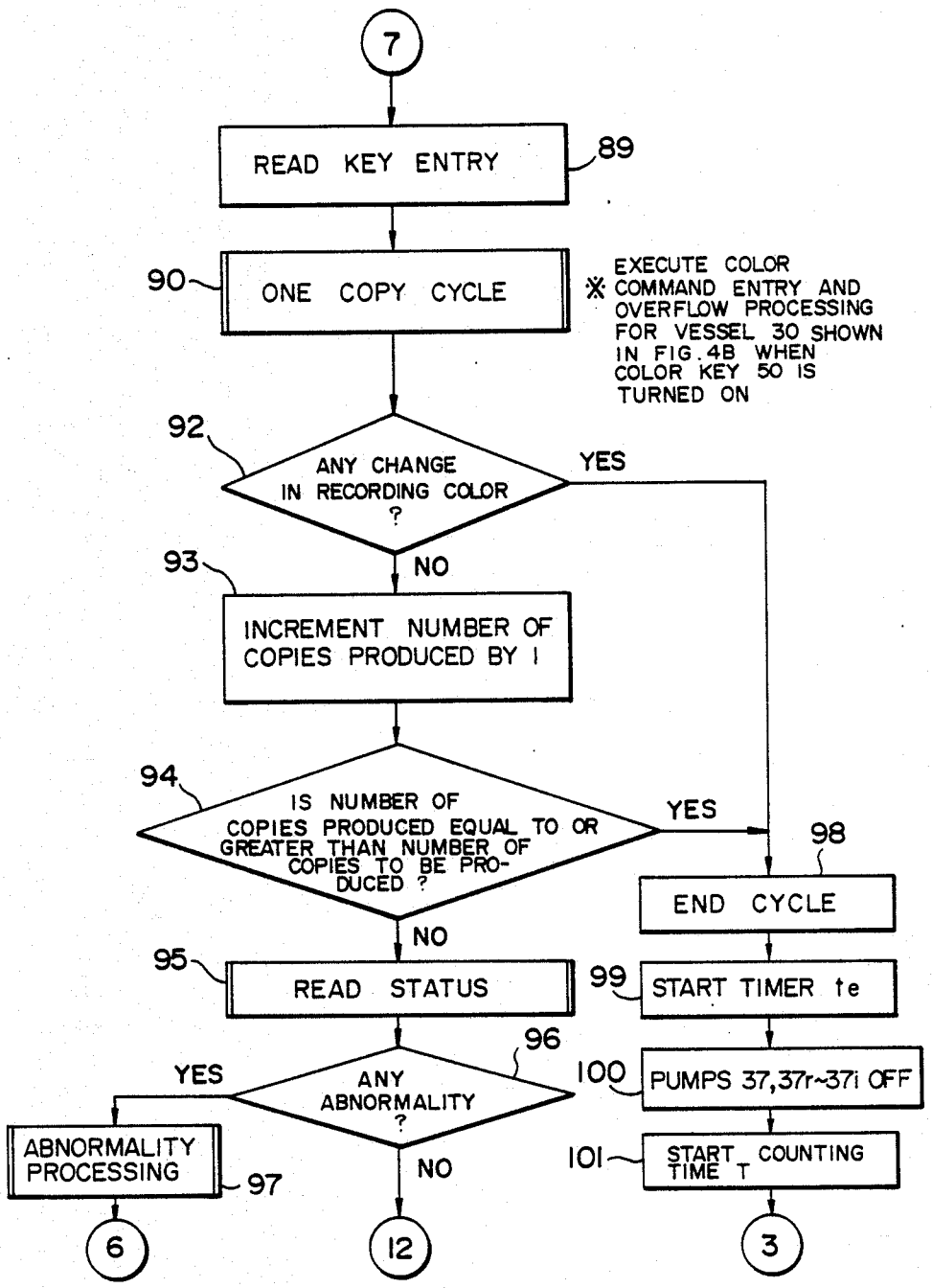
Figure 4F:
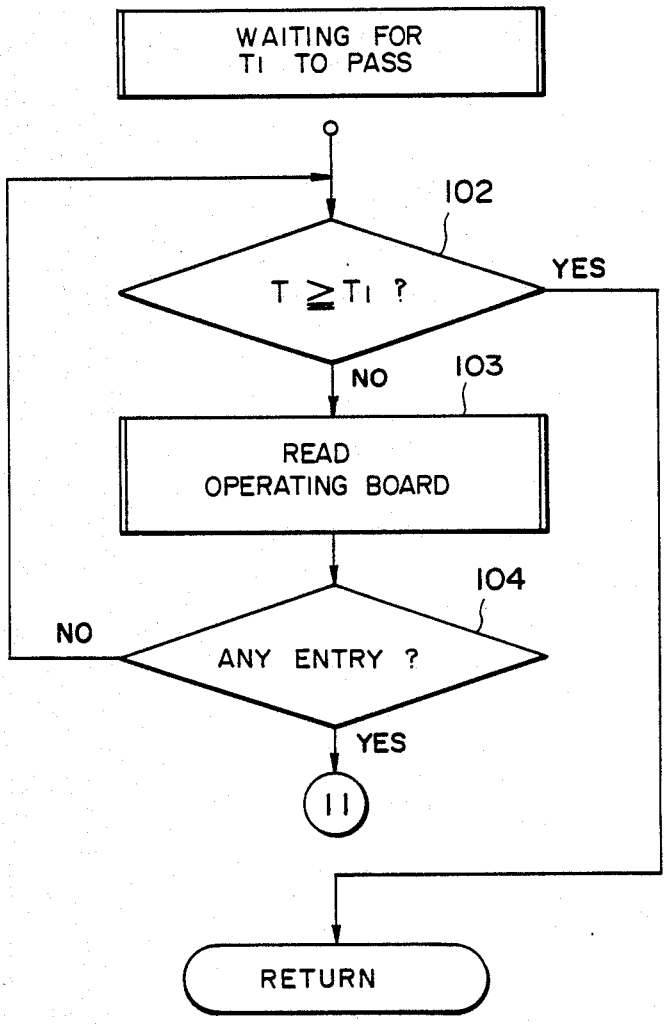

Referring to FIG. 4F, the "waiting for $T_1$ to pass" operation will be described. Because a counting operation to count the time T has already been initiated, it is determined if the time T is or is not equal to $T_1$ (step 103), and if there is any entry to the operating board, the program proceeds to the step 25 as shown in FIG. 4A, performing a processing in accordance with the entry. It is therefore possible that the recording color once specified may be altered during the time the program waits for $T_1$ to pass, as a result of an operation of the switch 50. When the recording color specified is altered, and if the "cleared" flag is set, this means that the developing unit 5 has ben completely cleaned and now is in a clean condition. If the "cleaned" flag is reset, this means that a cleaning operation s required. If it to be noted that hate location for "wait for $T_1$ to pass" operation (steps 50, 53 and 58) is located before the step 59 for positioning the nozzle 44 and, hence, the position of the nozzle 44 is not changed to a one corresponding to the color flag.

If the recording color (color flag) is altered by detecting an operation applied to the switch 50 which is found during a reading of the operating board during "wait for $T_1$ to pass" operation (steps 50, 53 and 58 of FIG. 4F), the nozzle 44 is disposed to discharge the liquid developer which is used prior to the previous color (color flag) for which a copying operation has not bee performed, so that there is produced no error in the positioning control of the nozzle 44. If the "cleaned" flag is set when the recording color (color flag) is altered, the cleaning step 55 and the cleaning liquid drain-off time $T_1$ waiting step 58 are not executed, preventing the previous cleaning operation from becoming wasteful. In this matter, the time after the recording color (color flag) is altered until the next copying operation s initiated is reduced.

When neither the black nor the blue flag is set, the green flag is examined (step 62 of FIG. 4D). If the green flag is set, the green developing operation (63) is executed. It should be born in mind that the green developing operation (step 53) is similar to the blue developing operation (steps 49 to 61) mentioned previously, with mutatis mutandis modification that "**40*b*" is replaced by "46*g*" at the step 52, "47*b*" by "47*g*" at the step 59, and "37*b*" by "37*g*" at the step 60. When none of the black, blue and green flags is set, it is the red flag that is set so that the program executes the red developing operation (step 44). The red developing operation (step 63) is similar to the blue developing operation (steps 49 to 61) mentioned previously, with mutatis mutandis modification that "46*b*" is replaced by "46*r*" at the step 52, "47*b*" by "47*r*" at the step 59, and "37*b*" by "37*r*" at the step 60**.

When the developing operation s executed as described above, either pump 37 (step 46), **37*b* (step 60), 37*g* (step 63) or 37*r* (step 64) is energized. Accordingly, when the recording color is altered next, a cleaning operation for the developing unit 5 is required although it is not required when changing form either one of blue, green and red to black. Thus, the "cleaned" flag is cleared (step 65*a*), and the program then proceeds to the adjustment of the liquid developer which begins with a step 65*b*. In the adjustment of liquid developer, the blue flag is initially examined to see if it is set (step 65*b*). If it is set, the pump 37*b* is energized to supply the blue developing solution from the fourth vessel 30*b* to the developing unit 5, and the discharged liquid from the latter is passed through the concentration detector unit 36*b* to be returned to the fourth vessel 30*b*. In this instance, the adjustment of the blue liquid developer (steps 66 to 81**) is executed.

Specifically, a voltage outputted by the photoelectric transducer element in the concentration detector unit **36*b* (FIG. 3) is subjected to A/D conversion and the resulting digital value is compared against a preselected value (step 66). If the digital value is equal to or greater than the preselected value of the concentration, this means that a proper concentration s established for the liquid developer. Accordingly, a number of times n the liquid developer is to be supplied is reset or cleared to 0 (zero) (step 73*a*), and the status of the switch 35*b* is examined (step 73*b*). If the switch 35*b* is not closed, this means that a proper level of liquid developer is established in the fourth vessel 30*b* so that the trouble indicator lamps 54*b*, 55 and 57 are extinguished (step 74), and a number of copies alteration flag is cleared (step 75), subsequently proceeding to a step 83. If the switch 35*b* is closed, this means that the liquid developer is depleted or at least the diluent container 32*b* is empty and, hence, the indicator lamps 54*b*, 55 and 57 are illuminated (step 76) and a number of remaining copies to be produced is compared with 99 (steps 78). If the number of remaining copies to be produced is equal to or less than 99, no change is applied. However, if such number exceeds 99, the number of copies to be produced is equal to 99 (step 79) and the number of copies alteration flag is et (step 80). In this manner, the number of copies which can be produced subsequently is limited within 99. If the number of copies alteration flag has already been set when the indicator lamps are illuminated at the step 76**, this means that there has been a previous alteration in the number of copies and, hence, the number of copies is not altered at this stage.

If it is found that the concentration is less than a preselected one as a result of the detection of concentration at the step 66, the status of the switch **34*b* is examined (step 68). If it is closed, there is a likelihood that an overflow of the liquid developer form the fourth vessel 30*b* may result if the developer from the container 31*b* is supplied to the fourth vessel 30*b*. Accordingly, the number of copies is altered according to the steps 76 and 80 as mentioned previously. When the switch 34*b* is not closed, there is no likehood of an overflow, and the number of times n the developer has been supplied is examined (step 69) and, if it is less than 5, the solenoid assembly 33*b* is energized for a time interval $t_6$ (step 70). As a result, the container 31*b* is opened for the time interval $t_6$, and the developer from the container 31*b* is supplied to the fourth vessel 30*b*. After a time interval $t_7$ which allows the developer supplied to be mixed with the existing developer within the vessel 30*b* and then supplied to the developing unit 5 and thence fed to the concentration detector unit 36*b*, the number of times n the developer has been supplied is incremented by 1 (one) (step 72), followed by the detection of the concentration (step 66**).

If the concentration is determined to be still low after the above detection, the developer is again supplied from the container **31*b* to the fourth vessel 30*b* (steps 69 to 72). When the concentration exceeds the preselected value, the program proceeds from the step 67 to a step 73***a*, thus making an exit from the loop of supplying the developer. If five consecutive times of supply of the developer fails to set up a concentration equal to or greater than the preselected value, this means that there is no supply of developer within the container 31*b*, the program thus proceeding to the alteration of the number of copies which is performed at the steps 76 and 80.

After the adjustment of the liquid developer as discussed above, the program advances to a step 81 where statuses of the switches 34*g*, 34*r* and 34*i* are examined. If the switch 34*g*, 34*r* or 34*i* is closed, there is a likelihood that the positioning of the nozzle 44 is unusual and the liquid developer fed from the fourth vessel (blue liquid developer vessel) 44 to the developing unit 5 has been delivered to the other vessel 30*r*, 30*g* or 30*i*. The program, therefore, proceeds to an abnormality processing 82. If all the switches 34*g*, 34*r* and 34*i* are open, the program determines that the nozzle 44 is accurately positioned and, then examines a status of the switch 34 (step 83). If it is closed, there is a likelihood that the blue liquid developer which has been transferred from the unit 5 to the drum 3 during a blue copying operation is partly collected by the cleaning unit 9 to be routed to the first vessel (black liquid developer vessel) 30, causing the amount of liquid in the vessel 30 to be increase and, thereby, the vessel 30 to overflow. If the switch 34 is closed, therefore, the program proceeds to the steps 39–41, i.e. color alteration processing. If the switch 34 is not closed, then the program advance to a copy control as shown in FIG. 4E.

What has been discussed above is the adjustment of the blue liquid developer when the blue flag is set. The adjustment of the green liquid developer (steps 84 and 85) when the green flag is set takes place similarly as the adjustment of the blue liquid developer with mutatis mutandis modification that "36*b*" is replaced by "36*g*" at the step 66, "34*b*" by "34*g*" at the step 68, "54*b*" by "54*g*" at the steps 74 and 76, "33*b*" by "33*g*" at the step 70, and "35*b*" by "35*g*" at the step 73*b*. The adjustment of the red liquid developer when the red flag is set (steps 86 and 87) takes place similarly as the adjustment of the blue liquid developer, with mutatis mutandis modification that "36*b*" is replaced by "36*r*" at the step 66, "34*b*" by "34*r*" at the step 68, "54*b*" by "54*r*" at the steps 74 and 76, "33*b*" by "33*r*" at the step 79, and "35*b*" by "35*r*" at the step 73*b*. The adjustment of the black liquid developer when the black flag is set (step 88) takes place similarly to the adjustment of the blue developing solution, with mutatis mutandis modification that "36*b*" is replaced by "36" at the step 66, "34*b*" by "34" at the step 68, "54*b*" by "54" at the steps 74 and 76, "33*b*" by "33" at the step 70, and "35*b*" by "35" at the step 73*b*.

During a black copying operation, the black developer is fed from the first vessel 30 to the developing unit 5 while the developer from the unit 5 is returned to the vessel 30. Also, the liquid collected from the unit 41 is returned to the vessel 30. Hence, the amount of liquid in the vessel 30 does not increase and, rather, decreases. This allow a copy cycle to be initiated or continued even if the switch 34 is closed. With this in view, so long as all the switches are not closed as determined by a decision corresponding to the step 81, the program advances to the copying control of FIG. 4E bypassing the step 83.

A copying control will be described with reference to FIG. 4E. Initially the program enables a reading of key entry to the operating board 48 (step 89), initiating one copy cycle (step 90). During one copy cycle, a single copying operation takes place which per ce is well known in the art. If there is a key entry on the operating board 48 during the copying operation, data from an entry key switch is stored. If the key entry is from the color command switch 50, the color flag which then prevails is saved in a memory as an old color flag, executing the processing shown in FIG. 4B. After this execution the color used in the current copying operation (old color flag) is different from the one which is established anew. Upon completion of one copy cycle (step 90), an examination is made at a step 92 to see if there has been any change in this color flag. If there is no change, the content of a number of copies produced register is incremented by 1 (one) (step 93), and the content of the register is compared with that of a number of copies to be produced register (step 94).

Figure 4G:
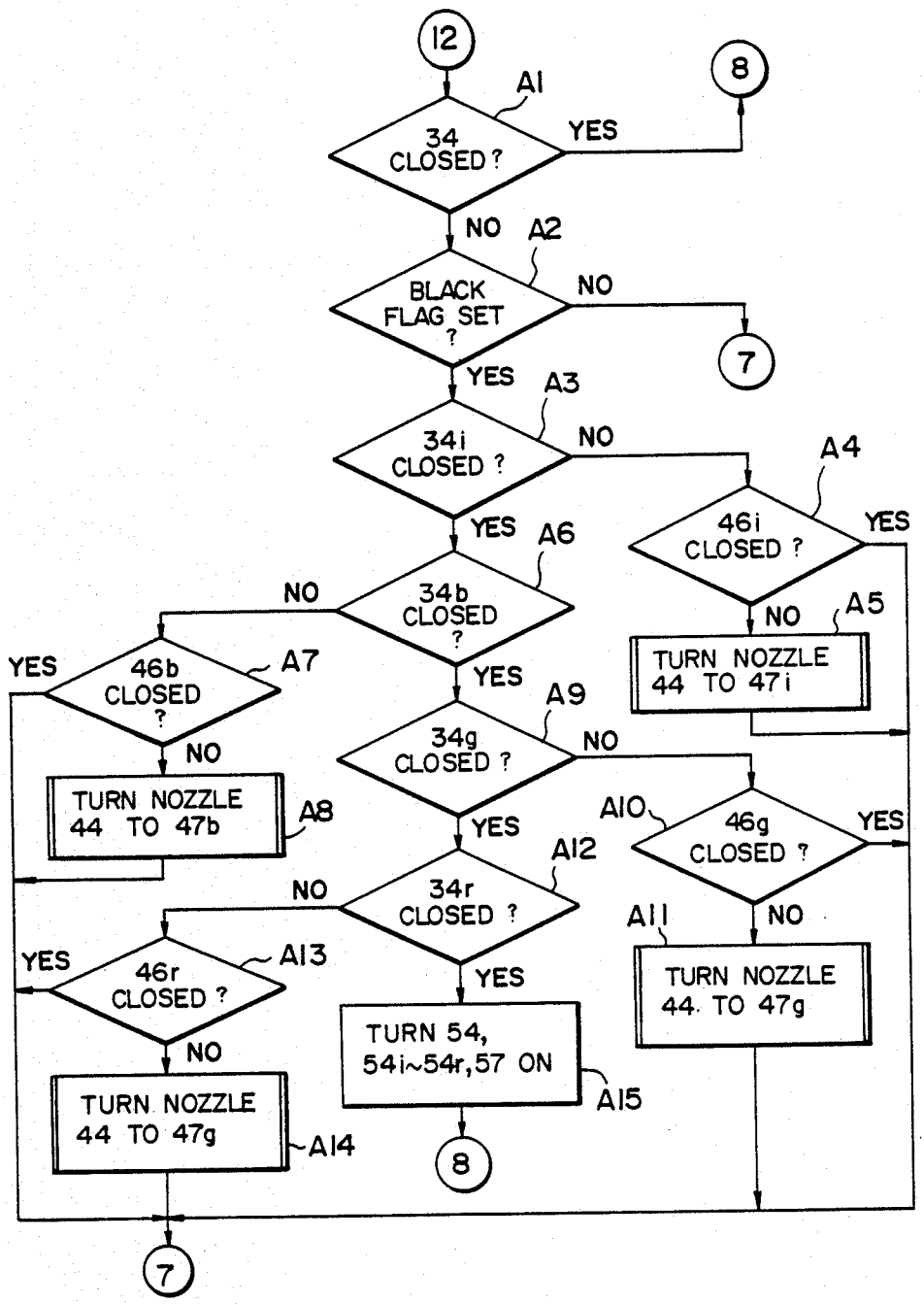

Unless the number of copies produced exceeds the number of copies to be produced, a copying operation (step 90) is still required to be repeated and, hence, the status of various parts of the copier is read (step 95) and it is determined whether the copying operation may be continued (step 96). If the copying operation may be continued, the program proceeds to an abnormality processing (step 97). If there is no abnormality in the copier and the copying operation may be continued, the program returns to the starting step 89 of the copying control after proceeding through a distribution control (steps A1 to 14) of a liquid (diluent) to be recovered from the purifier CA when the black recording mode is established, as shown in FIG. 4G. If the number of copies produced is equal to or greater than the number of copies to be produced, or if the color flag has changed during one copy cycle (step 90) during one copy cycle (step 90), the program enters a post-processing end cycle (step 98), starts a timer having a time $t_e$ which determines the end of the end cycle (step 99), deenergizes the pumps 37, 37*r*, 37*g* and 37*b* which are used to supply the liquid developers (step 100), and begins counting the time T (step 101). The program then returns to the reading of the operating board (step 14) as shown in FIG. 4A. As the pumps 37, 37*r*, 37*g* and 37*b* are deenergized, there is no supply of developers to the developing unit 5 and any developer contained within the unit 5 flows down by gravity to the individual respective vessel 30, 30*r*, 30*g* or 30*b*. Stated another way, a drain-off of the developer is initiated. Accordingly, a count of the time T is representative of time which has elapsed from the end of the copying operation.

When the copying operation has been completed in the manner mentioned above and the program has returned to the reading of the operation board (step 14), the program then loops around the steps 14, 15, 16, 17 and 14, waiting for any entry to the operating board 48, waiting for the termination of the end cycle (or until the time $t_e$ times out), and a waiting for the time $t_3$ to pass over. It is to be noted that $t_3$ is greater than $t_e$. If there is an entry to the operating board 48 before the time $t_e$ elapses, the control which begins with the step 25 is initiated. If the time $t_e$ expires without any entry to the operating board 48, the end cycle is terminated (step 18). At this time, the rotation of the drum 3 is stopped, the operations of other mechanisms are stopped, the pump 38 is deenergized, and the main charger 4 is deenergized. Subsequently, when the time $t_3$ passes, the standby mode is established (steps 19 and 20) and, thereafter, the program waits for the standby switch 76 to be turned on (step 21). When the switch 76 is turned on, the main motor is set in motion, the pump 38 is energized, the main charger 4 is energized (step 22), and the fixing heater is energized for heating at an elevated temperature (step 23), the program then proceeding to the reading of the operating board (step 14).

Referring to FIG. 4G, the distribution control (steps A1 to 14) of a liquid (diluent) recovered from the purifier CA in the black recording mode will be described. The status of the switch 34 is initially examined (step A1). If the switch 34 is closed, this means that the filter sleeve FL is plugged, presenting a likelihood that an overflow may occur from the first vessel 30. Then the program proceeds to the overflow processing (steps 38–41) as shown in FIG. 4B. If the switch 34 is open, it is determined that the filter sleeve FL is at least capable of absorbing a liquid developer which flows out of the overflow port of the first vessel 30. Accordingly, the black flag is examined (step A2). If the black flag is set, the black developer is supplied from the first vessel 30 to the developing unit 5 and, then, discharged from the unit 5 to be returned to the vessel 30 via the switching valve 39, thus being cicuitlated. In the event when the liquid developer flows through the overflow port of the vessel 30, the diluent which is obtained by filtration of the developer is fed to either one of the second to the fourth vessels and the cleaning liquid vessel. However, if the liquid in the vessel which is chosen to receive the diluent has already reached its upper limit, an overflow from this vessel maya result. To eliminate such an occurrence, at steps A3, A6, A9 and A12, the open or closed condition of the upper limit detecting switches of the second to the fourth vessels and the cleaning liquid vessel are examined in the sequence of the switches 34*i*, 34*b*, 34*g* and 34*r*. This means that the vessel to which the dilution liquid is to be directed is chosen in the sequence of the cleaning liquid vessel 30*i*, blue developer vessel 30*b*, green developer vessel 30*g*, and red developer vessel 30*r*. Hence, the status of the switch 34*i* is checked first (step A3) and, if it is open, indicating that the cleaning liquid has not reached its upper limit level, the nozzle 44 is located above the pipe 47*i* at steps A4 and A5. If the switch 34*i* is closed, indicating that the cleaning liquid has reached its upper limit level, the status of the switch 34*b* is examined (step A6) and, if it is open, indicating that the blue developer has not reached its upper limit level, the nozzle 44 is located above the pipe 47*b* at steps A7 and A8. If the switch 34*b* is closed, indicating that the blue developer has reached its upper limit level, the status of the switch 34*g* is examined (step A9) and, if it is open, indicating that the green developer has not reached its upper limit level, the nozzle 44 is located above the pipe 47*g* at a steps A10 and A11. If the switch 34*g* is closed, indicating that the blue developer has reached its upper limit level, the status of the switch 34*r* is examined (steps A3) and, if it is open, indicating that the red developer has not reached its upper limit level, the nozzle 44 is located above the pipe 47*r* at steps A13 and A14. If the switch 34*r* is closed, indicating that the red developer has reached is upper limit level, if follows that up to this step all of the switches 34*i*, 34*b*, 34*g* and 34*r* are closed and, if any vessel is chosen to recover the diluent, there is a likelihood of an overflow from such a vessel. Accordingly, the indicator lamps 54, 54*i*, 54*b*, 54*g* and 54*r* and 57 are illuminated (step A15), and the program proceeds to step 39 of FIG. 4B, disabling the copying operation.

The control operation of the CPU 58 as discussed above may be summarized as follows:

(1) Establishing the black recording color when turning on the power supply: The black flag is set (step 2) during the initialization which immediately follows the application of the power supply, initially storing the black recording in a memory. It is presumed that producing copies recorded in black represents the highest probability in a copier of the kind described. Hence, the recording color which is chosen as the standard copy condition is determined to be black. However, any other color can be commanded by entry to the operating board which takes place subsequently. If the black developer has begun to be supplied to the developing unit 5, it is necessary to stop the supply of the black developer and to provide a drain-off time $T_1$ for the black developer, a cleaning period $t_2$ and a drain-off time $T_1$ for the cleaning liquid, and it will be seen this degrades the operational efficiency of the copier. For this reason, the supply of the developer to the unit 5 is not initiated immediately upon choosing black as the recording color by storing it in the memory.

(2) Standby which immediately follows the application of the power supply: When the power is applied, a counting of the time T is initiated (step 2), waiting for the time T to reach $T_1$ or for the temperature of the active area of the fixing unit 24 to reach a fixing temperature (step 7*b*). The drain-off time $T_1$ for the developer which as been used during the previous copying operation may or may not have elapsed before the power is applied. In a commercial version of an actual implementation, an instruction manual thereof includes a description that the power supply for the copier be interrupted after the completion of the end cycle. When the power supply is turned off subsequent to the completion of the end cycle, the time $T_1$ has passed before the power supply is turned off. Accordingly, when the power supply is turned on again, it is needless to provide a drain-off time $T_1$. However, though of a reduced probability, it is possible that the power supply be turned off during the copying operation or immediately after the completion of the copying operation and then turned on again before the time $T_1$ elapses. To cope with this probability, in this particular embodiment, a uniform rule is applied that a drain-off time $T_1$ be used in principle when the power supply is turned on. If the power supply is turned when the fixing unit 24 assumes a normal temperature, the length of time which is required for the temperature of the active area to reach a preselected fixing temperature is greater than $T_1$. Thus, the rule that the drain-off time $T_1$ immediately follows the application of the power supply does not degrade the operational efficiency of the copier to any significant degree. However, if the power supply is interrupted subsequent to the end cycle after the completion of the previous copying operation and is immediately turned on again (turning on the power supply in this manner represents a high probability), the temperature of the active area is high, and a length of time corresponding to the drain-off time $T_1$ has normally passed since the completion of the previous copying operation. If follows that it is unnecessary for the time $T_1$ to expire since the power supply is turned on.

(3) Cleaning after the drain-off of the developer: It will be seen that the standby mode mentioned under the paragraph (2) has allowed the developer to be satisfactorily drained from the developing unit 5. Immediately after the standby mode, it is uncertain that a key entry to the operating board 48 will occur, and it is also uncertain what color will be specified for the recording. If the power supply is turned on when the fixing unit 24 assumes a normal temperature as when the power is turned on for the first time in the morning, the temperature of the active area has not risen to a given fixing level after this stage. In other words, it is in a warm-up mode. The cleaning of the developing unit 5 takes place at this stage (step 12). During the cleaning period, at least the main charger 4 is energized to attract any toner on the rollers of the unit 5 toward the drum 3 and, thereby, remove it from the rollers. The energization of the main charger 4 causes the toner on the rollers of the unit 5 to be attracted onto the drum 3, thus reducing a contamination of the cleaning liquid.

(4) Standby for drain-off after the cleaning operation: When the cleaning operation is completed, the "cleaned" flag is set, waiting for the time $T_1$, which is required to allow the cleaning liquid to be drained off from the developing unit 5, to pass. In the meantime, a reading of the operating board takes place (steps 13 and 14).

(5) Selection of a recording color: During the reading of the operating board (steps 14 and 103), if an operation of the color command switch is detected, a corresponding recording color is selected (steps 29 to 41). In this instance, when the liquid level in the first vessel (black liquid developer vessel) 30 is above the upper limit, only black is selected. This is to prevent the vessel 30 from overflowing.

(6) If an operation of the start switch 49 is detected during the reading of the operating board (steps 14 and 103), the developing operation is enabled (steps 42 to 64: supply of developer to the developing unit 5), provided the various parts of the copier except for the developing system are enabled for copying operation, followed by the adjustment of developer (steps **65*b* to 83) and, then, the copying operation (steps 89 to 101**).

(7) When enabling the developing operation as mentioned under the paragraph (6), actual supply of developer is compared with a supply of developing operation which is required for the present operation.

(7-1) When they match, the program proceeds to the adjustment of the developer. This allows the copying operation to be initiated immediately in response to the operation of the start key switch, in a similar manner as in a usual monochromatic copier. When they doe not match;

(7-2A) If the color of the developer which is required for the present operation is either red, green or blue;

(7-2A-1) The program waits for the drain-off time $T_1$ for the developer which has been used previously to pass (steps 50 and 53) and then executes the cleaning operation (step 55), followed by waiting for the drain-off time $T_1$ for the cleaning liquid (step 58). The program then proceeds to the adjustment of the developer.

(7-2A-2) When the "cleaned" flag is set, this means that the developing unit 5 has just been cleaned. Therefore, it is necessary to wait for the drain-off time $T_1$ for the previous developer to pass (steps 50 and 53) and to execute the cleaning operation (step 55), both of which are omitted here. Then, the program waits for the drain-off time $T_1$ for the cleaning liquid to pass (step 58).

(7-2A-3) While waiting for the drain-off time $T_1$ to pass, the operating board is read (step 103) and, if any entry is found, the program returns to the paragraph (5).

(7-2B) If the color of the developer which is required for the present operation is black, the operations mentioned under the sub-paragraph (7-2A-1), (7-2A-2) and (7-2A-3) are not executed. Accordingly, the copying operation with the black color is initiated with a considerably reduced length since the entry of a corresponding command as compared to the recording operation with other colors and, thus, is generally similar to a usual monochromatic copying operation.

(7-3) The "cleaned" flag is cleared (step **65*a*) whenever one of the developer supply pumps 37, 37*r*, 37*g* and 37*b*** is energized.

(8) In the adjustment of the developer as mentioned under the paragraph (6), if an insufficient concentration of the developer is detected, a corresponding developer is supplied from an associated container to a desired vessel. If the concentration is still low after such a supply, the number of copies to be produced is altered so that the number of copies to be produced subsequently is equal to or less than 99. The number of copies to be produced is altered similarly when the level of the developer within the vessel is low. If the upper limit detecting switch has detected that the developer has reached the upper limit even through the concentration is low, the supply of the developer is not effected while restricting the number of copies to be produced within 99. This is for the purpose of restricting the number of copies to be produced subsequently to 99 copies for which the acceptable quality is assured when the developer has an insufficient concentration or when the quantity of the developing solution is less than desired. When the developer reaches the upper limit level, the supply of the developer ceases in order to prevent an overflow, resulting in an insufficient concentration. This explains for the restriction of the number of copies to be produced subsequently to 99 copies for which an acceptable quality is assured.

(9) In the adjustment of developer as stated under the paragraph (6), if the liquid levels in the developer vessels which store developers of colors other than the selected one and the liquid level in the cleaning vessel are above their upper limits, the program determines that the direction of developer supply (position of the switching valve 39 or that of the nozzle 44) is unusual and advances to the abnormality processing to prevent a copying cycle from being initiated.

(10) In the adjustment of developer as stated under the paragraph (6), if the selected color is either red, green or blue, and if the liquid level in the first vessel 30 of that instant is above the upper limit (step 83), the program changes the color to black and, thereafter, returns to the step 14 for reading the operating board. When the selected color is black, the program does not change the selected color and does not return to the reading of the operating board in order to avoid an overflow of the vessel 30.

(11) The operating board is read also during one copying cycle, with any entry being stored in a memory. The memory is examined subsequent to the completion of the one copying cycle and, if it is found that there is a change in the recording color command (step 92),the end cycle is set up, followed by a return to the reading of the operating board (step 14).

(12) Upon completion of the copying operation, the time is started in order to determine the termination of the end cycle (step 99), and the counting of the time T is initiated in order to determine a count of the time during which the machine has been left unused subsequent to the completion of the copying operation and, also, in order to monitor the drain-off of the developer from the developing unit 5 (step 101). The systems which supply and recover the developer to or from the unit 5 are left unchanged without any initialization because there is a high probability that the same color may be selected for the next copying operation and because the standby for the drain-off or the cleaning operation will have to be performed wastefully if the initialization is made. Subsequenty, if the time $t_e$ times out without any entry to the operating board (while the start switch 49 remains on), the end cycle is terminated (as by stopping the rotation of the drum) (step 18) and, if the standby time $t_3$ passes subsequently without any entry to the operating board, the copier enters the standby mode where the fixing heater is energized for heating at a lowered temperature (steps 19 to 21). During the standby mode, no reading of the operating board (step 14) takes place unless the standby switch 76 is operated (steps 21 to 23). If the switch 76 is operated to proceed to the reading of the operating board (step 14) before the standby mode is entered or during the standby mode, and if it is found that there is a change in the recording color either from black to the red, green or blue or alternatively from one of red, green and blue to a different color other than black, the count of the time T which has been initiated at the terminal of the copying operation is examined, and a cleaning operation is initiated (steps 54 and 55), provided the time T is equal to or greater than $T_1$ (steps 50 and 53). Thus, initiating the counting of the time T since the completion of the copying operation (step 101) is effective to reduce the waiting time when the recording color is subsequently changed than when a fresh standby time for the drain-off is established.

(13) During the cleaning operation (steps 12 and 55), the reading of the operating board (steps 14 and 103) is not executed while the reading of the operating board (step 103) is executed during the standby for the drain-off either before or after the cleaning operation (steps 50, 53 and 58). This is because the cleaning time $t_2$ has a relatively short during and hence it does not take a long time to wait for its completion and because any desired recording color can be selected subsequent to the cleaning operation, so that once the cleaning operation is initiated it is reasonable to allow the cleaning operation to be completely finished. The reading of the operating board (step 103) is executed during the standby for the drain-off since the latter takes a relatively long time $T_1$ during which an operator may desire to change the recording color. Thus, if there is an entry to the operating board and a corresponding processing is permitted to occur, the counting of the time T may be continued, thus maintaining the continuity of the standby for the drain-off.

(14) When the cleaning operation is executed (steps 12 and 55), the "cleaned" flag is set, indicating that the developing unit 5 remains cleaned. Subsequently when the developer supply pump 37, **37*r*, 37*g* or 37*b* is energized, this flag is cleared (step 65*a*). If the "cleaned" flag is set when changing the recording color to a different one, except when changing from one of red, green and blue to black, the standby for the drain-off of the previous developer and the cleaning operation are omitted while performing only the standby for the cleaning liquid before the supply of the new developer is initiated. This has an effect of cutting down the standby time. In particular, when the recording color is changed during the reading of the operating board (step 103) which takes place during the standby for the drain-off of the cleaning liquid (step 58), the standby time until the copying operation is initiated can be reduced in the developing operation which occurs subsequent to the change in the color (steps 48 to 65*a***).

(15) In the black recording operation, the nozzle 44 is disposed so as to supply the cleaning liquid to the vessel **30*i*. In the black recording operation, the developing solution within the developing unit 5 is returned to the first vessel 30. If the developer flows to the overflow port of the first vessel 30, the solvent (diluent) from which the toner is removed passes through the purifier CA to the vessel 30*i*. When the liquid level within the vessel 30*i* is at its upper limit or when the switch 32*i* is closed, the nozzle 44 is disposed so as to pass the liquid to the vessel 30*b*. If the liquid level within the vessel 30*b* is at its upper limit or the switch 34*b* is closed, the nozzle 44 is disposed to pass the liquid to the vessel 30*g*. Further, if the liquid level within the vessel 30*g* is at its upper level or the switch 34*g* is closed, the nozzle 44 is disposed to pass the liquid to the vessel 30*r*. When the liquid levels in all the vessels 30*i*, 30*b*, 30*g* and 30*r* are at their upper limits, the abnormality indicator lamp is illuminated and the copying operation is interrupted. In the event when either blue, green or red is selected as the recording color, the nozzle 44 is so disposed as to return the developer from the unit 5 to the vessel which corresponds to this color, so that the nozzle 44** is not changed in order to select the path for the liquid recovered from the purifier CA.

(16) When the upper limit detecting switch 34 of the black developer vessel 30 is closed, this means that the developer from the vessel 30 flow to the purifier CA, the filter sleeve FL of which is plugged to raise the liquid level within the first vessel 30 slightly above the overflow port. Accordingly, the abnormality indicator lamp is illuminated and the copying operation interrupted. Thus, the illumination has the significance of warning a plugging which has occurred within the filter sleeve FL as well as an excessive quantity of liquid within the first vessel.

Figure 5:
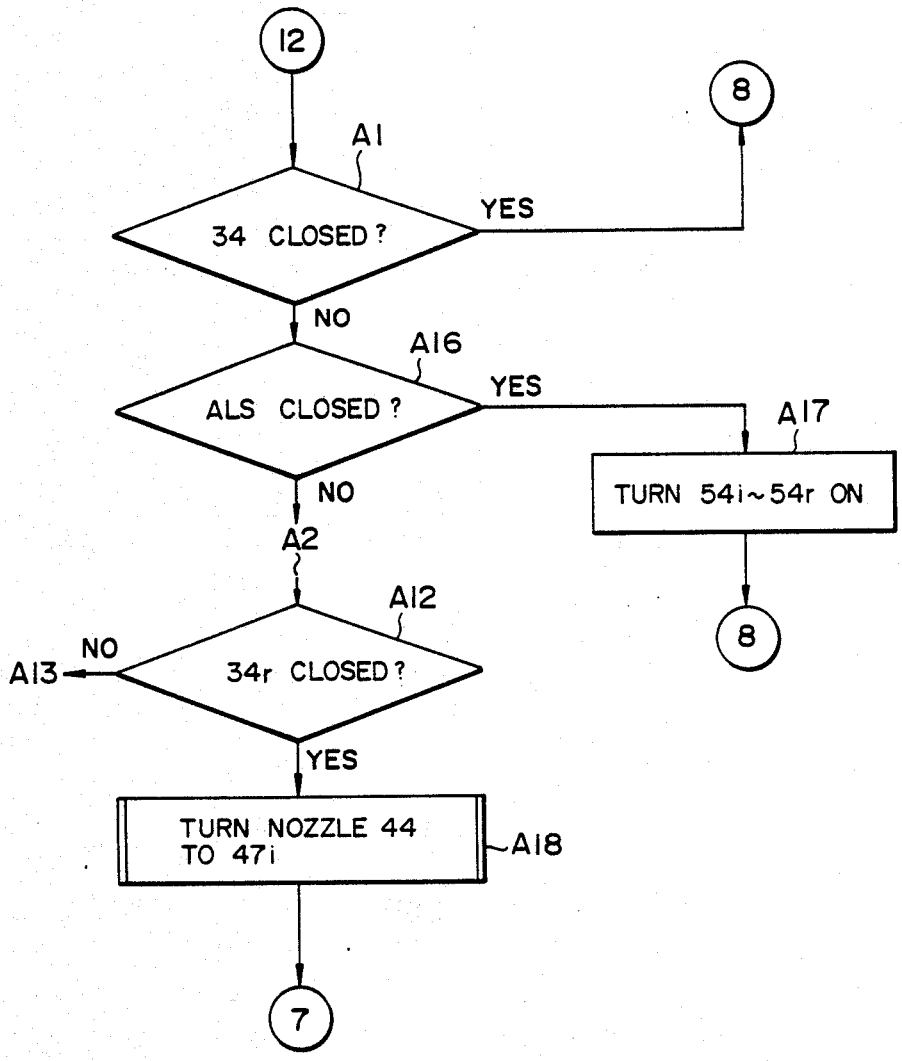
FIG. 5 is a flowchart demonstrating another control procedure.

Referring again to FIG. 1, in accordance with the present invention, there is also provided an effluent vessel AT as indicated by a dash-and-dots line. The effluent vessel AT is disposed so that any liquid flowing to the overflow ports APi, APb, APg and APR of the vessels **30*i*, 30*b*, 30*g* and 30*r*, respectively, can be introduced into the vessel AT. These overflow ports are formed at a level which is slightly above the level at which the switches 34*i*,34*b*, 34*g* and 34*r* detects the upper limit or become closed. In this construction, the liquid in any of the vessels 30*i*, 30*b*, 30*g* and 30*r* flows into the effluent vessel AT after the switch 34*i*, 34*b*, 34*g* or 34*r* associated therewith has detected the upper limit. The vessel AT is provided with a float and an upper limit detecting switch ALS which is capable of detecting the fact that the vessel is substantially filled with a liquid. The status of the switch ALS is read by a CPU corresponding to the CPU 58. In this case, among the controls performed by the CPU (58), the distribution control of the liquid collected by the purifier CA as described with reference to FIG. 4G is modified as shown in FIG. 5**.

Specifically, a step A16 which examines the status of the upper limit detecting switch ALS of the effluent vessel AT is inserted between the steps A1 and A2, as shown in FIG. 4G. When the switch ALS is closed, indicating that the vessel AT is full, the indicator lamps **54*i* to 54*r* are illuminated at a step A17 to alert the operator to this effect, followed by the steps 39 and 82 shown in FIG. 4***b*, disabling the copying operation. In addition, if the switch 34*r* is also closed at the step A12, indicating that the liquid level has reached is upper limit in each of the vessels 30*i*, 30*b*, 30*g* and 30*r*, the nozzle 44 is disposed for connection with the cleaning liquid vessel 30*i* to proceed to the copying operation shown in FIG. 4E without proceeding to the abnormality processing in order to prevent any excessive reduction in the concentration of the developers in the vessels 30*b*, 30*g* and 30*r*.

By the above procedure, if the liquid level reaches the upper limit in all the vessels 30*i*, 30*b*, 30*g* and 30*r*, the liquid recovered from the purifier CA is introduced into the cleaning vessel 30*i* to allow the copying operation (in black) to be continued as long as the upper limit detecting switch LS of the vessel AT remains open, indicating that the vessel AT is ready to accommodate a further quantity of liquid. When any of the blue, green and red recording takes place with an increased consumption of toner, accompanying a repeated supply of and, therefore, an increase in the quantity of the developer, any excess liquid will be passed through the overflow port to the vessel AT. This allows the supply of the developer to be continued if the upper limit detecting switch is closed when a reduction in the concentration of the developer requires such a supply. In other words, the steps 68 and 76 to 80 as shown in FIG. 4D are omissible. In this instance, a copying operation may be continued without any substantial reduction in the concentration until the switch ALS of the vessel AT becomes closed.

Figure 6:
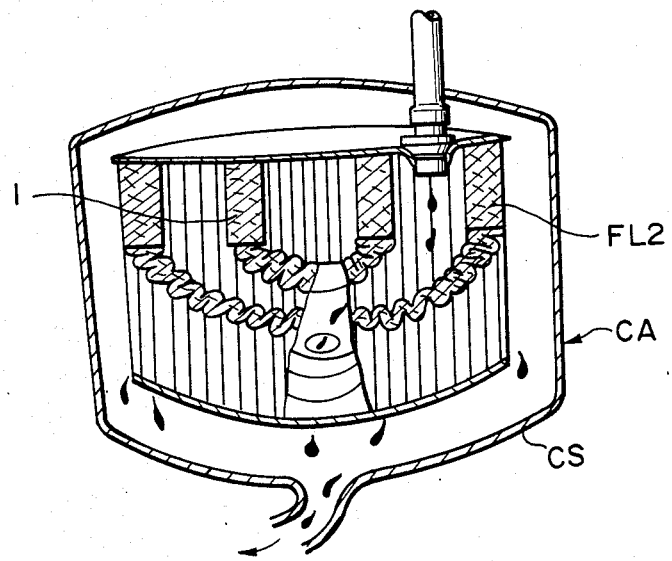
FIGS. 6 and 7 show a modification to the purifier of FIG. 1 in a sectional view and a perspective view, respectively.
Figure 7:
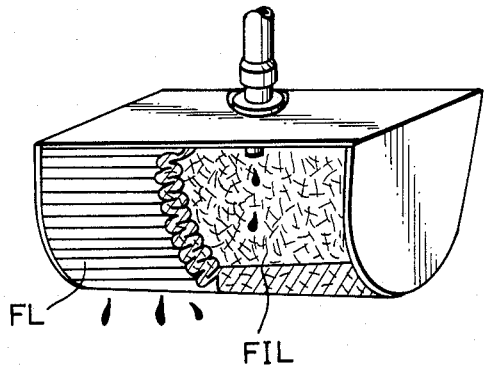

It will be seen that the greater the filtration capacity of the filter sleeve FL of the purifier CA, the less the probability that the copying operation must be interrupted due to the abnormality. This can simply be achieved by increasing the size of the filter sleeve FL. To obtain an increased filtration capacity without significantly increasing the volume, a filter sleeve as shown in FIG. 6 may be used. As shown, it comprises a pair of inner and outer sleeves FL1 and FL2, with the internal space within the inner sleeve FL1 communicating to that of an outermost container CS. This increases the filtration capacity without any substantial increase in the volume of the purifier CA, by increasing a filtration area by an amount which corresponds to the sleeve FL1 added. A further increase in the filtration capacity may be achieved by interposing a filler having a filtering capacity or toner absorbing capability such as natural fibers, synthetic fibers, filaments of other materials, activated charcoal, ion exchange resins. When a positive use of such filler is made, the filter sleeve FL may be shaped semi-circular in cross section as indicated in FIG. 7, with the interior being filled with a filler FIL. In any case, any liquid in the developing unit 5 is returned to the first vessel 30, which contains the black developer, through the switching valve 39 while any liquid in the unit 5 is returned to other vessels through the valve 39, common path IMP and nozzle 44, with any excess amount of developing solution which flows out of the first vessel 30 being passed through the purifier FL which removes the toner therefrom to leave only the solvent (diluent) which can be distributed to other vessels. Accordingly, if the level of the developer within the vessel 30 rises due to the return of the toner recovered by the cleaning unit 9 to the vessel 30 and due to an increased supply of the developer to the vessel 30 from the container 31 which is necessitated by a black recording with a high image rate or high solid content, the recording in the black color or any other color may be continued until a plugging occurs within the filter sleeve FL. As a consequence, if the black recording with a high solid content is frequently made or if the recording with colors other than black is frequency used, the described arrangement substantially eliminates the need to interrupt the copying operation due to the limit of the liquid receiving capability of the vessel 30 being reached, thus improving the operational efficiency of the copier. Further, in accordance with the present invention, the addition of the effluent vessel At offers an extra improvement in the operational efficiency of the copier in that a black recording with a high solid rate or a recording of a different color alone can be continued over an increased length of time, and also substantially prevents the occurrence of an overflow from a vessel which contains a developer of a particular color even when a recording in this color with a high solid rate is frequency made. In this manner, the need to interrupt the copying operation due to an overflow is eliminated, and the copying operation may be continued so long as the effluent vessel is capable of receiving a liquid.

The first vessel 30 has been shown and described as containing the black developer, i.e. choosing the black as the first color. However, in a manner in which the previous developer is recovered by the vessel 30 whenever a recording color is changed from a color other than black to black, it is not always necessary to contain the pure black developer in the vessel 30 since any mixing with a recovered developer of a color other than the black results in substantially black developer being contained therein. Accordingly, the vessel 30 which contains a developer of the first color need not be supplied with the pure black developer.

In the foregoing description, when the recording color is changed from red, green or blue to black, the particular pump 37*r*, 37*g* or 37*b* which has been previously supplying the developer is ceased and the switching valve is immediately changed for connection with the vessel 30 (step 45) and the pump 37 is energized (step 46). This is based on the presumption that the amount of liquid developer contained in the developing unit 5 is low and, hence, if the previous developing solution is recovered by the vessel 30, an increase in the amount of developer in the vessel 30 will be small and a change in the color of the black developer is substantially negligible. However, in embodiments in which such a change is not negligible, a controls step similar to the step 50 which waits for the time $T_1$ to expire may be inserted between the steps 44 and 45. In this modification, the supply of the black developer is initiated after waiting for the drain-off of the previous developer, thus reducing the amount of developer recovered by the vessel 30 and reducing the degree of mixing of the black developer with another or others.

In the construction shown and described, there is no backup power source which maintains the memory operative when the power switch is turned of and, hence, it is necessary that when the power supply is turned on the drain-off time $T_1$ be allowed before the cleaning operation and the initialization of the developing unit 5. However, in an embodiment which includes a backup power source capable of maintaining a counter counting the time T, a microprocessor or a combination of a microprocessor and a RAM operative, the steps 7*b* to 13 stated above may be omitted so as to reduce the length of time required from the turn-on of the power supply to the initiation of the copying operation. In such an embodiment, if the power switch is allowed to remain off for a prolonged period of time, an automatic cleaning control may be included which effects a cleaning operation once at a given length of time after the power switch has been turned off. This would effectively prevent a solidification and adherence of the developer to the rollers in the unit 5.

In an embodiment including the backup power source to allow necessary data to be saved in the event when the power switch is turned off as stated above, three or all of the switches 46 responsive to the positions of the nozzles 44 may be omitted. Then, the remaining switch, say 46*i*, may be utilized to detect the home position. Where all the four switches are omitted, an arrangement may be made such that the nozzle 44 is located over a particular one of the pipes 47, for example, above the pipe 47*i* , and nozzle position data is stored in a non-volatile memory which is maintained operative by the backup power source so that the nozzle position data may be updated for each step in either forward or reverse direction of the pulse motor 45, thus performing a position tracking capability. A similar control may be utilized in tracking the position of the switching valve 39, thus allowing the switch 43 to be eliminated.

The copier described above is representative of a monochromatic copier. However, the present invention is also applicable to a superimposed full color copier in which a paper conveying mechanism adapted to selectively guide a paper from the outlet of the fixing unit 24 to the inlet of the register roller 22 and a filter unit made up of a plurality of filters is interposed between the drum 3 and the mirror 15. In operation, when a full color recording operation is required, a copying operation for cyan C, magenta M and yellow Y may be performed in a given sequence while sequentially returning the single paper from the fixing unit 24 to the register roller 22 and changing the filter of the filter unit which is disposed in the exposure path. In this manner, the present invention is equally applicable to a full color copier.

The present invention is applicable not only to a semi-moist process color copier as shown and described but also to a dry process color copier. In the case of a dry process color copier, the cleaning agent is implemented with powder capable of adsorbing toner or a solvent capable of solving or dispersing toner.

Furthermore, the present invention is similarly applicable to any other type of recording apparatus having a recording medium located in a facing plane. In a color ink jet printer, for example, three independent ink jet heads are installed and each is supplied with one of different colors of ink, e.g. magenta, cyan and yellow. In accordance with the present invention, the different colors of ink are supplied to a single ink jet head while the respective colors of ink and a cleaning liquid are selectively routed from vessels associated therewith to the head; the ink or the cleaning liquid which is caught by a gutter is returned to the cleaning liquid vessel by way of a switching valve and others.

The present invention allows a copying cycle using a liquid developer stored in a first vessel to be repeated a great number of times with little variation in density. This holds true with any of other developers which are contained in the other vessels. Such remarkably enhances the operational efficiency of the recording apparatus while preventing the liquid in the first vessel from undergoing an unusual overflow.

Further, in accordance with the present invention, an overflow tank is associated with a liquid container which constitutes a part of a liquid circulation systems such as a developing vessel of a color copier and allows a liquid or liquid to flow thereinto from another system. By installing the overflow tank in any desired space, it is possible to considerably increase the volume of the container without rendering the apparatus bulky. In addition, the overflow tank is handled independently of the container to eliminate overflows of the container without affecting the liquid circulation system. Furthermore, a piping extending out from the overflow tank to reach a level where sensor means responsive to liquid levels in the container is located furnished the apparatus with a capability of sensing both of the liquid level in the container and that in the overflow tank by use of single sensor means and, therefore, a simplified construction. The overflow tank may be designed as a disposable tank to cut down the cost of the apparatus.

Various modifications will become possible for those skilled in the art after receiving the teachings of the present disclosure without departing from the scope thereof.

What is claimed is:

1. A recording apparatus having a visualizing device which supplies a recording medium with visualizing liquid of different colors for recording information on the recording medium, comprising:

first visualizing liquid vessel means which contains a visualizing liquid of a first color and is provided with an overflow port;

second visualizing liquid vessel means containing a visualizing liquid of a color which is different from the first color;

first supply means for supplying the visualizing liquid contained in said first visualizing liquid vessel means to the visualizing device;

second supply means for supplying the visualizing liquid contained in said second liquid vessel means to the visualizing device;

path switching means for selectively delivering any of the visualizing liquids discharged from the visualizing device to said first and second visualizing liquid vessel means;

purifier means interposed between said overflow port of said first visualizing liquid vessel means and said second visualizing liquid vessel means for capturing developing agents which are contained in the visualizing liquids;

color commanding means for commanding a color in which a recording is to be made;

state monitoring means for monitoring the visualizing liquid supply state of the visualizing device; and liquid supply control means for comparing a color commanded by said color commanding means with the color of said visualizing liquid monitored by said state monitoring means and, if the color of the visualizing liquid in the visualizing device is different from the commanded color, then any of said first and second supply means corresponding to the commanded color are activated to supply the selected visualizing liquid while said path switching means is activated to deliver visualizing liquid to said supply means which corresponds to the commanded color. path switching means a delivery to said supply means which corresponds to the commanded color.

2. A recording apparatus as claimed in claim 1, wherein said second visualizing liquid vessel means comprises a second vessel containing a visualizing liquid of a second color which is different from the first color, a third vessel containing a visualizing liquid of a third color which is different from the first and second colors, and a fourth vessel containing a visualizing liquid of a fourth color which is different from the first, second and third colors.

3. A recording apparatus as claimed in claim 2, wherein said second visualizing liquid vessel means further comprises a cleaning liquid vessel containing a cleaning liquid therein.

4. A recording apparatus as claimed in claim 3, wherein said second supply means comprises a second supply unit for supplying the visualizing liquid contained in said second vessel to the visualizing device, a third supply unit for supplying the visualizing liquid contained in said third vessel to the visualizing device, a fourth supply unit for supplying the visualizing liquid contained in said fourth vessel to the visualizing device, and a cleaning liquid supply unit for supplying the cleaning liquid contained in said cleaning liquid vessel to the visualizing device.

5. A recording apparatus as claimed in claim 4, wherein said path switching means comprises a first switching unit for selectively supplying any of the visualizing liquids discharged from the visualizing device to said first vessel means and said second vessel means, a unitary conduit for routing any of the visualizing liquids which if fed toward said second visualizing liquid vessel means, and a second switching unit for selectively supplying the liquid in said common path to said second vessel, third vessel, fourth vessel and cleaning liquid vessel.

6. A recording apparatus as claimed in claim 5, wherein said purifier means is interposed between said overflow port of said first vessel and said common path.

7. A recording apparatus as claimed in claim 6, wherein said second visualizing liquid vessel means comprises liquid level upper limit detector means which are provided one in each of said second vessel, third vessel, fourth vessel and cleaning vessel.

8. A recording apparatus as claimed in claim 7, wherein said liquid supply control means is constructed to command said first switching unit a supply to said first vessel when the commanded color is the first color and, by referencing outputs of said liquid level upper limit detector means, commands said second switching unit a supply to any of said vessels in which a liquid level upper limit is not detected.

9. A recording apparatus as claimed in claim 8, wherein said second liquid vessel means further comprises overflow ports which are provided one in each of said second vessel, third vessel, fourth vessel and cleaning vessel and located at a higher level than the liquid level upper limit, and an effluent vessel communicating to said overflow ports.

10. A recording apparatus as claimed in claim 9, wherein said effluent vessel comprises liquid level upper limit detector means for detecting a liquid level upper limit of effluent, said liquid supply control means being constructed to alert to an effluent level exceeding a predetermined upper limit when said liquid level upper limit detector means has detected the upper limit.

11. A recording apparatus as claimed in claim 10, wherein said first liquid vessel means comprises liquid level detector means responsive to a liquid level which is higher than a level of said overflow port of said first vessel.

12. A recording apparatus as claimed in claim 11, wherein said purifier means comprises a filter member which partitions an inner space communicating to said overflow port of said first vessel and an outer space communicating to said common path, which delivers a purified liquid to said second liquid vessel means, form each other.

13. A recording apparatus as claimed in claim 12, wherein said liquid supply control means is constructed to alert to a clogging of said filter member when said liquid level upper limit detector means has detected the upper limit.

14. A recording apparatus as claimed in claim 12, wherein said first visualizing liquid vessel means further comprises an effluent vessel communicating to said overflow port of said first vessel.

15. A recording apparatus having a visualizing device which supplies a recording medium with visualizing liquids of different colors for recording information on the recording medium comprising, in combination:

first visualizing liquid vessel means which contains a visualizing liquid of a first color and is provided with an overflow port;

second visualizing liquid vessel means comprising a second vessel containing a visualizing liquid of a second color which is different from the firsts color, a third vessel containing a visualizing liquid of a third color which is different from the first and second colors, a fourth vessel containing a visualizing liquid of a fourth color which is different from the first, second and third colors, and a cleaning liquid vessel containing a cleaning liquid therein;

first supply means having a first visualizing liquid supply unit for supplying the visualizing liquid contained in said first visualizing liquid vessel means to the visualizing device;

second supply means comprising a first switching unit for selectively supplying any of the visualizing liquids discharged from the visualizing device to said first vessel and second visualizing liquid vessel means, common path means for routing any of the visualizing liquids which is fed toward said second visualizing liquid vessel means, and a second switching unit for selectively supplying the liquid in said common path means to said second vessel, third vessel, fourth vessel and cleaning liquid vessel;

path switching means for selectively delivering any of the visualizing liquids discharged from the visualizing device to said first and second visualizing vessel means;

purifier means interposed between said overflow port of said first visualizing liquid vessel means and said second visualizing liquid means for capturing developing agents which are contained in the visualizing liquids, said purifier means comprising a filter member which partitions an inner space communicating to said overflow port of said first vessel and an outer space communicating to said common path means, which delivers a purified liquid to said second liquid vessel means, from each other;

color commanding means for commanding a color in which a recording is to be made;

state monitoring means for monitoring the visualizing liquid supply state of the visualizing device; and liquid supply control means for comparing a color commanded by said color commanding means with the color of said visualizing liquid supply state monitored by said state monitoring means and, if the color of the visualizing liquid in the visualizing device is different from the commanded color, then any of said first and second supply means corresponding to the commanded color are activated to supply the selected visualizing liquid while said path switching means is activated to deliver visualizing liquid to said supply means which corresponds to the commanded color.

16. A recording apparatus as claimed in claim 15, which in said second supply means comprises a second visualizing liquid supply unit for supplying the visualizing liquid contained in said second vessel to the visualizing device, a third visualizing liquid supply unit for supplying the visualizing liquid contained in said third vessel to the visualizing device, a fourth visualizing liquid supply unit for supplying the visualizing liquid contained in said fourth vessel to the visualizing device, and a cleaning liquid supply unit for supplying the cleaning liquid contained in said cleaning liquid vessel to the visualizing device.

17. A recording apparatus as claimed in claim 15, wherein said purifier means is interposed between said overflow port of said first vessel and said common path means.

18. A recording apparatus as claimed in claim 17, wherein said second visualizing liquid vessel means comprises liquid level upper limit detector means which are provided one in each of said second vessel, third vessel, fourth vessel and cleaning vessel.

19. A recording apparatus as claimed in claim 18, wherein said liquid supply control means is constructed to command said first switching unit a supply to said first vessel when the commanded color is the first color and, by referencing outputs of said liquid level upper limit detector means, command said second switching unit a supply to any of said vessels in which a liquid level upper limit is not detected.

20. A recording apparatus as claimed in claim 19, wherein said second liquid vessel means further comprises overflow ports which are provided one in each of said second vessel, third vessel, fourth vessel and cleaning vessel and located at a higher level than the liquid level upper limit, and an effluent vessel communicating to said overflow ports.

21. A recording apparatus as claimed in claim 20, wherein said effluent vessel comprises liquid level upper limit detector means for detecting a liquid level upper limit of effluent, said liquid supply control means being constructed to alert to an excessively high effluent level when said liquid level upper limit detector means has detected the upper limit.

22. A recording apparatus as claimed in claim 21, wherein said first liquid vessel means comprises liquid level detector means responsive to a liquid level which is higher than a level of said overflow port of said firsts vessel.

23. A recording apparatus as claimed in claim 15, wherein said liquid supply control means is constructed to alert a clogging of said filter member when said liquid level upper limit detector means has detected the upper limit.

24. A recording apparatus as claimed in claim 15, wherein said first visualizing liquid vessel means further comprises an effluent vessel communicating to said overflow port of said first vessel.

25. A recording apparatus having a visualizing device which supplies a recording medium with visualizing liquids of different colors for recording information on the recording medium comprising, in combination:

first visualizing liquid vessel means which contains a visualizing liquid of a first color and is provided with an overflow port;

second visualizing liquid vessel means containing a visualizing liquid of a color which is different from the first color;

first supply means having a first visualizing liquid supply unit for supplying the visualizing liquid contained in said first visualizing liquid vessel means to the visualizing device;

second supply means for supplying the visualizing liquid contained in said second liquid vessel means to the visualizing device;

path switching means for selectively delivering any of the visualizing liquids discharged from the visualizing device to said first and second visualizing liquid vessel means;

purifier means interposed between said overflow port of said first visualizing liquid vessel means and said second visualizing liquid vessel means for capturing developing agents which are contained in the visualizing liquids;

color commanding means for commanding a color in which a recording is to be made;

state monitoring means for monitoring the visualizing liquid supply state of visualizing device; and liquid supply control means for comparing a color commanding by said color commanding means with the color of said visualizing liquid supply state monitored by said state monitoring means and, if the color of the visualizing liquid in the visualizing device is different from the commanded color, then any of said first and second supply means corresponding to the commanded color are activated to supply the selected visualizing liquid while said path switching means is activated to deliver visualizing liquid to said supply means which corresponds to the commanded color, said first visualizing liquid vessel means comprising an effluent vessel communicating to said overflow port of said first vessel, a discharge conduit extending into the interior of the effluent vessel form an intermediate point on a side wall of the first vessel between an upper limit and a lower limit of liquid level, an air vent conduit extending upwardly to a level above the upper limit, and a supporter for supporting the discharge conduit and air vent conduit together.

26. A recording apparatus as claimed in claim 25, wherein said supporter comprises a plug for closing a mouth of the effluent vessel.

27. A recording apparatus as claimed in claim 25, wherein said supporter comprises a T-elbow protruding from the side wall of the first vessel, said air vent conduit being connected to an upper connecting end of the T-elbow, said discharge conduit being connected to a lower connecting end of the T-elbow.

28. A recording apparatus as claimed in claim 25, wherein said second visualizing liquid vessel means comprises a second vessel containing a visualizing liquid of a second color which is different from the first color, a third vessel containing a visualizing liquid of a third color which is different from the first and second colors, and a fourth vessel containing a visualizing liquid of a fourth color which is different from the first, second and third colors.

29. A recording apparatus as claimed in claim 28, wherein said second visualizing liquid vessel means further comprises a cleaning liquid vessel containing a cleaning liquid therein.

30. A recording apparatus as claimed in claim 29, wherein said second supply means comprises a second visualizing liquid supply unit for supplying the visualizing liquid contained in said second vessel to the visualizing device, a third visualizing liquid supply unit for supplying the visualizing liquid contained in said third vessel to the visualizing device, a fourth visualizing liquid supply unit for supplying the visualizing liquid contained in said fourth vessel to the visualizing device, and a cleaning liquid supply unit for supplying the cleaning liquid contained in said cleaning liquid vessel to the visualizing device.

31. A recording apparatus as claimed in claim 30, wherein said path switching means comprises a first switching unit for selectively supplying any of the visualizing liquids discharged from the visualizing device to said first vessel and second visualizing liquid vessel means, common path means for routing any of the visualizing liquids which is fed toward said second visualizing liquid vessel means, and a second switching unit for selectively supplying the liquid in said common path means to said second vessel, third vessel, fourth vessel and cleaning liquid vessel.

32. A recording apparatus as claimed in claim 31, wherein said purifier means first interposed between said overflow port of said first vessel and said common path means.

33. A recording apparatus as claimed in claim 32, wherein said second visualizing liquid vessel means comprises liquid level upper limit detector means which are provided one in each of said second vessel, third vessel, fourth vessel and cleaning vessel.

34. A recording apparatus as claimed in claim 33, wherein said liquid supply control means is constructed to command said first switching unit a supply to said first vessel when the commanded color is the first color and, by referencing outputs of said liquid level upper limit detector means, command said second switching unit a supply to any of said vessels in which a liquid level upper limit is not detected.

35. A recording apparatus as claimed in claim 34, wherein said second liquid vessel means further comprises overflow ports which are provided one in each of said second vessel, third vessel fourth vessel and cleaning vessel and located at a higher level than the liquid level upper limit, and an effluent vessel communicating to said overflow ports.

36. A recording apparatus as claimed in claim 35, wherein said effluent vessel comprises liquid level upper limit detector means for detecting a liquid level upper limit of effluent, said liquid supply control means being constructed to alert an excessively high effluent level when said liquid level upper limit detector means has detected the upper limit.

37. A recording apparatus as claimed in claim 36, wherein said first liquid vessel means comprises liquid level detector means responsive to a liquid level which is higher than a level of said overflow port of said first vessel.

38. A recording apparatus as claimed in claim 37, wherein said purifier means comprises a filter member which partitions an inner space communicating to said overflow port of said first vessel and an outer space communicating to said common path means, which delivers a purified liquid to said second liquid vessel means form each other.

39. A recording apparatus as claimed in claim 38, wherein said liquid supply control means is constructed to alert to a clogging of said filter member when said liquid level upper limit detector means has detected the upper limit.

* * * * *